United States Patent [19]

Sakashita et al.

[11] 4,348,928

[45] Sep. 14, 1982

[54] ELECTRONIC MUSICAL INSTRUMENT

[75] Inventors: Noriji Sakashita; Toshio Kugisawa; Hironori Watanabe; Hiroshi Kitagawa, all of Hamamatsu, Japan

[73] Assignee: Kabushiki Kaishi Kawai Gakki Seisakusho, Japan

[21] Appl. No.: 834,427

[22] Filed: Sep. 19, 1977

[30] Foreign Application Priority Data

| | | | |
|---|---|---|---|
| Sep. 24, 1976 | [JP] | Japan | 51-114505 |
| Sep. 24, 1976 | [JP] | Japan | 51-114506 |
| Sep. 24, 1976 | [JP] | Japan | 51-114507 |
| Sep. 24, 1976 | [JP] | Japan | 51-114508 |
| Sep. 27, 1976 | [JP] | Japan | 51-115599 |
| Sep. 27, 1976 | [JP] | Japan | 51-115600 |
| Sep. 27, 1976 | [JP] | Japan | 51-115601 |
| Sep. 27, 1976 | [JP] | Japan | 51-115602 |

[51] Int. Cl.[3] ..... G10H 1/00

[52] U.S. Cl. ..... 84/1.01; 84/1.26

[58] Field of Search ..... 84/1.01, 1.03, 1.11, 84/1.19, 1.24, 1.26, DIG. 7, DIG. 8; 364/718, 723

[56] References Cited

U.S. PATENT DOCUMENTS

| | | | |
|---|---|---|---|
| 3,882,751 | 5/1975 | Tomisawa et al. | 84/1.26 |
| 3,982,460 | 9/1976 | Obayashi et al. | 84/1.01 |
| 3,982,461 | 9/1976 | Kugisawa | 84/1.03 |
| 4,022,098 | 5/1977 | Deutsch et al. | 84/1.01 |
| 4,030,395 | 6/1977 | Kugisawa | 84/1.03 |
| 4,085,644 | 4/1978 | Deutsch et al. | 84/1.01 |
| 4,128,032 | 12/1978 | Wada et al. | 84/1.01 |
| 4,148,017 | 4/1979 | Tomisawa | 84/1.01 |

*Primary Examiner*—J. V. Truhe
*Assistant Examiner*—Forester W. Isen
*Attorney, Agent, or Firm*—McGlew and Tuttle

[57] ABSTRACT

An electronic musical instrument of digital processing in which required musical waveshape data are calculated by a tone control device to obtain a complex musical waveshape and the complex musical waveshape is read out at a read frequency produced by a key closure to generate the selected musical note. The electronic musical instrument has a calculator for calculating a musical waveshape in association with the operation of the tone control device in a period of time independent of the period of the generated musical note, a read-out signal generator for producing a memory read-out signal based on the closure of the key switch, a period detector for detecting by one period of each channel resulting from the closure of the key switch, first and second memories for storing the musical waveshape from the calculator, the stored musical waveshape being read out by the read-out signal, and means for achieving such a control that while the first memory is read out, the musical waveshape is stored in the second memory, that the read output signal from the first memory is sequentially written in the second memory by the output signal from the period detector in synchronism with the period of the generated musical note and that after completion of reading out of a new first memory, the musical waveshape from the calculator is stored in the first memory.

3 Claims, 26 Drawing Figures

ELECTRONIC MUSICAL INSTRUMENT

BACKGROUND OF THE INVENTION

1. Field of the Invention

This invention relates to an electronic musical instrument, and more particularly to an electronic musical instrument in which conversion of a musical waveshape under the control of a tone control device does not exert any influence on the musical waveshape generation and which has a rapid response to the musical waveshape conversion. More in particular, the invention is directed towards an electronic musical instrument of the digital system in which required musical waveshape data are computed by a tone control device to obtain a complex waveshape and the complex waveshape is read out at a read-out frequency provided by closure of an instrument key-board switch to generate the selected musical note.

2. Description of the Prior Art

In an apparatus having a large number of key switches such as the keyboard of an electronic musical instrument, direct connection of the key switches to desired circuits for transmitting key information to selected ones of them as required will involve an enormous amount of wiring, and hence is very uneconomical. Further, it is difficult to employ the semiconductor integrated circuit techniques because of too large a number of pins used.

In view of the above, there has recently been considered a system which scans all of the keyboard switches in a predetermined period of time and generates pulses at the moments corresponding to depressed ones of the key switches, thereby to save the connections between the key switches and circuits. This type of system that has usually been employed is, for example, a key code multiplex in which information of depressed key switches detected by scanning all of the key switches on a time shared basis is transmitted in the form of a TDM (Time Division Modulation) or PCM (Pulse Code Modulation) signal. With such a system, however, since the time for scanning all of the key switches is fixed, there will be a waste of time in the case where the number of depressed key switches is small.

In a play of an ordinary keyboard musical instrument, a maximum number of key switches simultaneously depressed with both hands and feet is eleven. If each block of key switches is considered to cover one octave, it is impossible to depress the key switches of two or more octaves with one hand, so that a maximum number of blocks simultaneously occupied is five. Accordingly, the key switches are divided into a plurality of blocks and these blocks are scanned and when there is even one depressed key switch, scanning is stopped at that block and the depressed key switch is detected. Since scanning skips over those of the blocks in which no key switches are depressed, one scanning time for obtaining information of the depressed key switches can be shortened.

The required musical waveshape data are calculated by a waveshape calculator included in a tone control device to obtain a complex waveshape, which is read out by a read-out frequency produced by closure of a key switch, thereby to generate the selected musical note. In a conventional system for producing such a tone signal, the complex musical waveshape calculated by the waveshape calculator based on the musical waveshape data is written in a buffer register, from which it is written simultaneously in the note registers corresponding to channels $CH_1$ to $CH_n$ in a short time independently of the period of the produced note. Consequently, during key depression, a noise is generated by the waveshape calculation, exerting a bad influence on the waveshape generation controlled by the tone control device.

SUMMARY OF THE INVENTION

An object of this invention is to provide an electronic musical instrument in which conversion of a musical waveshape controlled by a tone control device does not affect the musical waveshape generation and which has a rapid response to the waveshape conversion.

Another object of this invention is to provide an electronic musical instrument which has a key code generator to provide for shortened time for scanning of all key switches.

Another object of this invention is to provide an electronic musical instrument which has a key code detector suitable for a key code signal generated from a key code generator for the purpose of shortening the scanning time.

Another object of this invention is to provide an electronic musical instrument which has a simple-structured envelope generator of a small memory capacity and producing an envelope which is smooth in waveshape during attack and release.

Another object of this invention is to provide an electronic musical instrument which has a note clock generator which generates frequencies corresponding to key information seized by respective channels and is constructed not to necessitate phasing of the same notes of different channels but to ensure them to be in-phase with each other at all times.

Another object of this invention is to provide an electronic musical instrument which has a memory of a small memory capacity but capable of storing with high accuracy a musical waveshape required by a tone control.

Another object of this invention is to provide an electronic musical instrument which has one or more tone selectors capable of achieving tone switching with a simple structure and with a rapid response.

Another object of this invention is to provide an electronic musical instrument which has a coupler device adapted to enable a coupler control of each keyboard with key code detectors of the same number as a maximum number of sounds simultaneously produced.

Still another object of this invention is to provide an electronic musical instrument which is designed so that the memory capacity for representing a required harmonic number may be reduced and that a step noise by sampling may be produced outside of the audible frequency range.

The foregoing objectives are achieved by providing an electronic musical instrument of digital processing in which required musical waveshape data are computed by a tone control device to obtain a complex musical waveshape and the complex musical waveshape is read out by a read-out frequency produced by closure of a key switch to generate the selected musical note, and in which there are provided a calculator for calculating the musical waveshape in association with the operation of the tone control in a period time independent of the period of the produced note, a read-out signal generator for producing a memory read-out signal based on the key switch closure, a period detector for detecting by the read-out signal one period of each channel resulting from the closure of the key switch, first and second memories storing the musical waveshape from the calculator and read out by the read-out signal, and means for achieving such a control that while the first memory is read out, a new musical waveshape is stored in the second memory from the calculator, that the read output signal from the first memory is sequentially written in the second memory by the output signal from the period detector in synchronism with the period of the generated musical note and that after completion of reading out of the first memory, a musical waveshape from the calculator is stored in the first memory.

DESCRIPTION OF THE PREFERRED EMBODIMENTS

This invention will hereinafter be described in detail with regard to its embodiments.

A description will be given first in connection with the outline of an example of an electronic musical instrument of a novel construction embodying this invention and then detailed circuit constructions of its respective parts.

The electronic musical instrument to which this invention is applied is one of the digital system in which a complex waveform is obtained by calculating required musical waveshape data and read out at a read-out frequency produced by closure of a key switch, thereby to generate the selected musical note.

Figure 1:
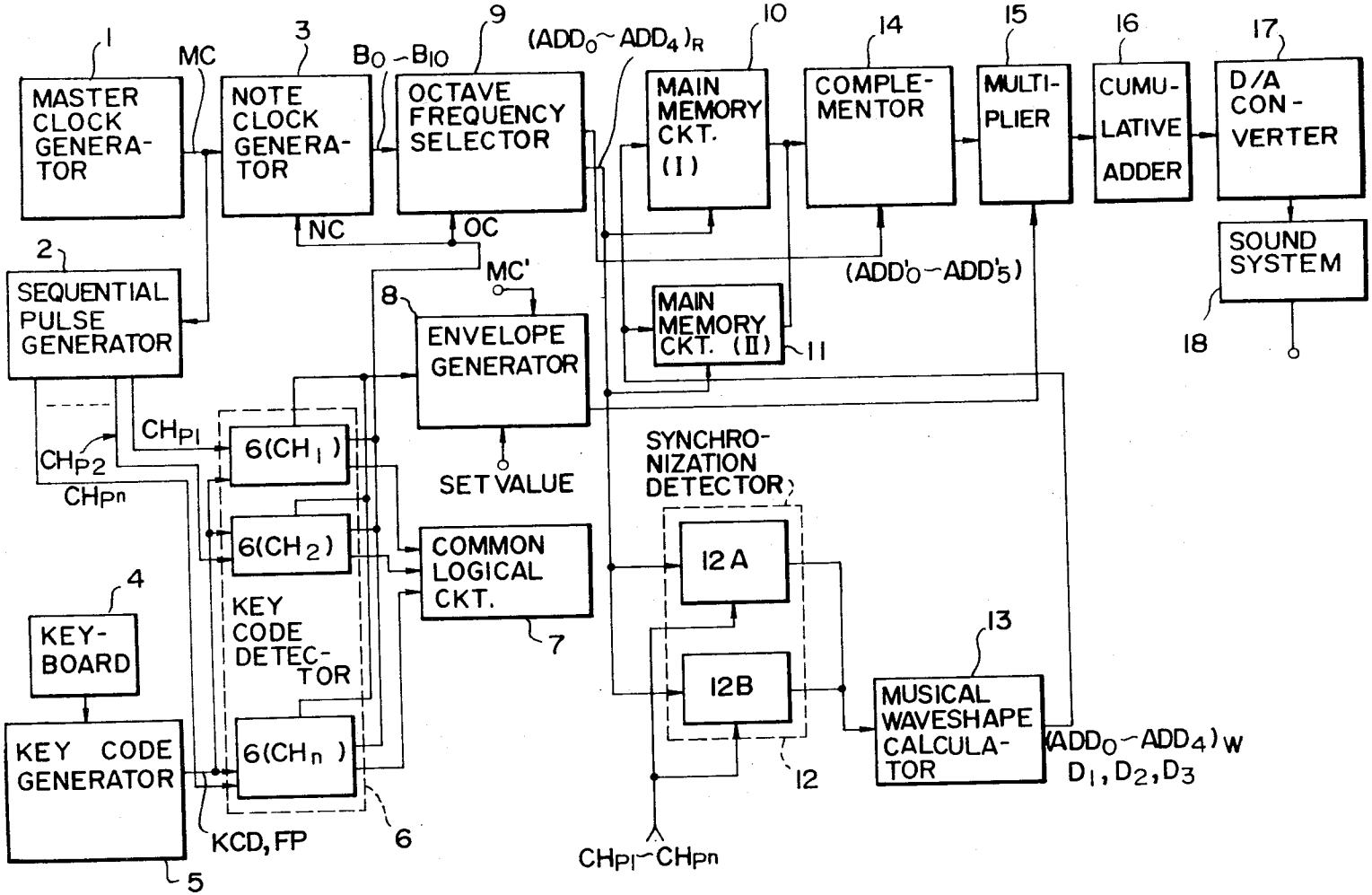
FIG. 1 is a basic block diagram showing the overall construction of an electronic musical instrument of this invention.

FIG. 1 is a basic block diagram illustrating the overall structure of the electronic musical instrument embodying this invention. In FIG. 1, key information from a keyboard 4 based on closure of a key switch is generated by a key code generator 5. The key switches are divided into a plurality of blocks and these blocks are scanned. When one or more key switches are closed in the block being currently scanned, the key switches of that block are scanned to detect the closed key switches. That is, scanning is carried out based on the variable frame system that one frame is made up with each of the blocks of key switches. In this manner, a key code signal KCD and a frame synchronizing signal FP are generated. A key code detector 6 comprises channel circuits 6($CH_1$), 6($CH_2$), . . . 6($CH_n$) of the same number as a maximum number of sounds which are simultaneously produced. Based on the key code signal KCD and the frame synchronizing signal FP mentioned above, the key code detector 6 detects whether or not the key code signal KCD is a previously seized one and whether or not the key switches are opened. The detected output from the key code detector 6 is applied to a common logical circuit 7. The common logical circuit 7 decides whether or not the key code signal KCD be captured and, in the case of capture, supplies the key code detector 6 with a signal designating the channel therefor. The key code detector 6 of the designated channel captures the key code signal KCD and, at the same time, starts counting of pulses from an envelope generator 8. The key code signal KCD is time divided by the corresponding channel pulse $CH_{pn}$ generated from a sequential pulse generator 2 which operates with a master clock pulse MC emanating from a master clock generator 1, and is applied to the envelope generator 8. In the envelope generator 8, envelope data always read out by an envelope master clock pulse MC' are counted to caluculate the corresponding envelope data, thereby obtaining an envelope waveshape. The status transition of the musical waveshape in the cases of attack, decay and sustain is controlled by a set value given to the envelope generator 8.

Further, the transition to release after closure of a key switch, that is, the key switch opening state, is achieved by the frame synchronizing signal FP and the key code signal KCD in the key code detector 6, the output from which is supplied to the envelope generator 8, and the data resulting from the release status are calculated.

A note signal NC included in the key code signal KCD seized by the key code detector 6 is time divided by channel pulse corresponding thereto and applied to a note clock generator circuit 3. The note clock generator circuit 3 is provided with note clock generators corresponding to twelve notes, and generates signals $B_0$ to $B_{10}$ corresponding to the respective notes based on the master clock pulse MC. The note signal NC is decoded and applied to the note generator corresponding thereto to turn ON a gate and the signals $B_0$ to $B_{10}$ are applied from the note signal generator circuit 3 through bus lines to an octave frequency selector 9. The octave frequency selector 9 selects the signals $B_0$ to $B_{10}$ in accordance with an octave signal OC and applies address read signals ($ADD_0$ to $ADD_4$)R to main memory circuits (I)10 and (II)11 and complement control signals ($ADD'_0$ to $ADD'_5$) to a complementor 14.

A musical waveshape calculator 13 is supplied with a signal from a synchronous detector 12 to detect closed ones of key switches of each draw bar switch and each tablet switch to detect and read out the corresponding waveshape data from the main memory circuits (I)10 and (II)11. And the musical waveshape calculator 13 sequentially calculates a new complex musical waveshape and writes, with address write signals ($ADD_0$ to $ADD_4$)W, amplitude values $D_1$ of the musical waveshape at the sample points thereof, a difference value $D_2$ in amplitude between successive sample points and sign bits $D_3$ indicative of positive or negative of the difference values $D_2$ in that one of the main memory circuits (I)10 and (II)11 designated by the synchronous detector 12. Upon completion of the write, in the designated synchronous detector 12A or 12B, one period of the musical note produced by closure of the key switch is detected from the address read signals ($ADD_0$ to $ADD_4$)R to start read-out of the main memory circuit (I)10 or (II)11 in which the new musical waveshape has been written. Upon completion of the read, a new complex musical waveshape is calculated by the musical waveshape calculator 13 and written in that one of the main memory circuits (I)10 and (II)11 in which no complex musical waveshape is being currently written.

The musical waveshape, read out with the address read signals ($ADD_0$ to $ADD_4$)R, is corrected in waveshape by the complement control signals ($ADD'_0$ to $ADD'_5$) supplied to the complementor 14, the output from which is fed to a multiplier 15, with a step noise frequency made constant regardless of the read-out frequency at all times. In the multiplier 15, the output from the complementor 14 is multiplied by the envelope waveshape supplied from the envelope generator 8, and the multiplied output is fed to an accumulator 16. An envelope is added to the musical waveshape based on the closed key switch, and the output from the accumulator 16 is converted by a D-A converter 17 into an analog signal for input to a sound system 18 which reproduces the musical note.

Figure 2:
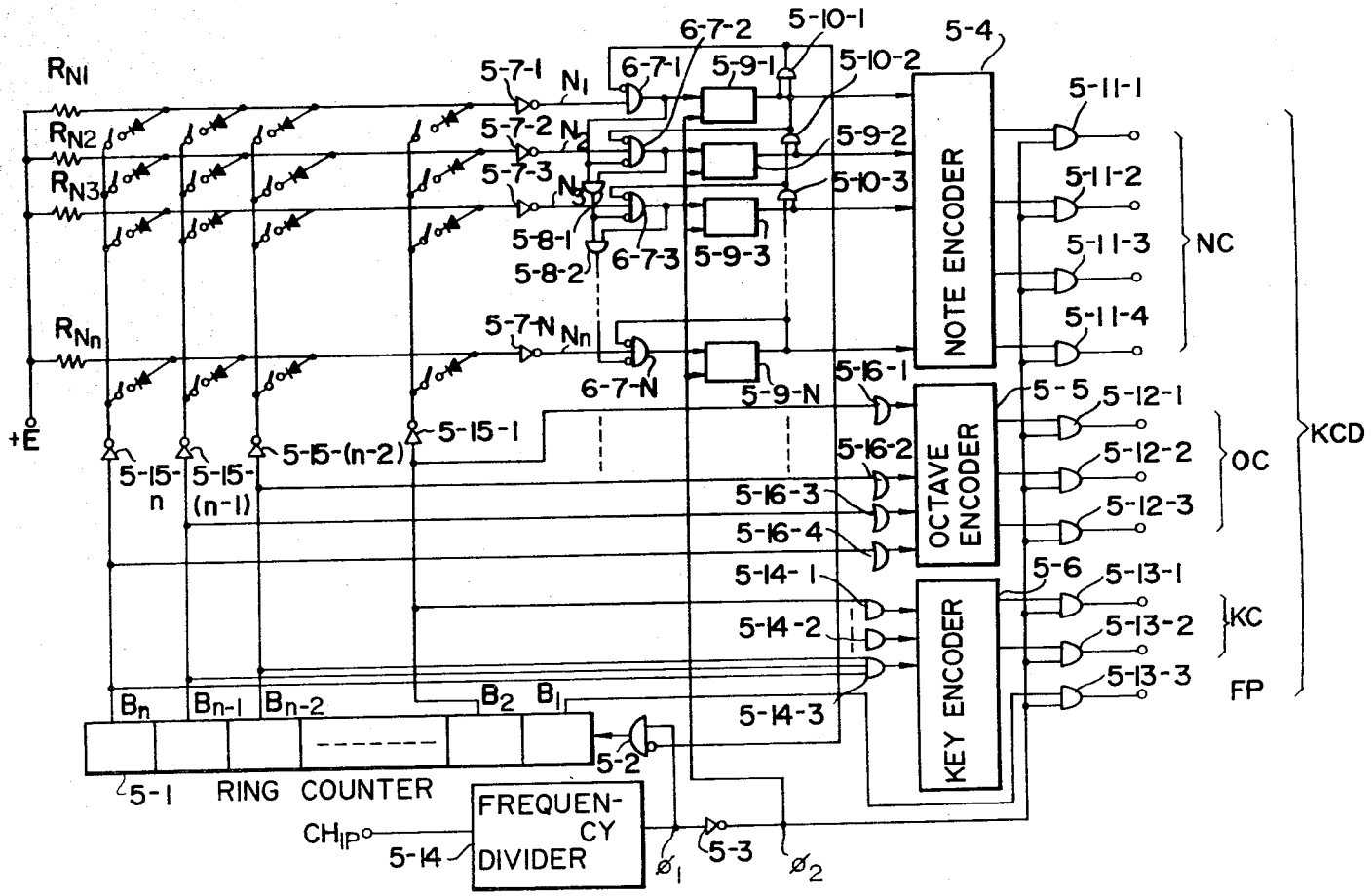
FIG. 2 is a detailed block diagram of a key code generator 5 of the electronic musical instrument shown in FIG. 1.

FIG. 2 is a detailed block diagram of the key code generator 5 of the electronic musical instrument shown in FIG. 1. In FIG. 2, a clock pulse $\phi_1$ that the clock pulse $CH_{p1}$ is frequency divided by a frequency divider 5-14 down to $\frac{1}{2}$ is applied via a gate 5-2 to a ring counter 5-1 described in detail later on. From the ring counter 5-1, "1" is provided on one of bus lines of its outputs ($B_1$ to $B_N$) and "0" on each of the other bus lines. On the bus line on which "1" is present is provided "1" via a corresponding one of NOT gates (5-15-1 to 5-15-N). For a closed one of the key switches arranged on that bus line, "1" is provided on the corresponding one of bus lines ($N_1$ to $N_n$) through a diode from the corresponding one of NOT gates (5-7-1 to 5-7-N). A voltage +E is applied to one end of the corresponding one of resistors ($R_{N1}$ to $R_{Nn}$) to the closed key, providing "0" on the line corresponding to the abovesaid one of the bus lines ($N_1$ to $N_n$) through the abovesaid one of the NOT gates (5-7-1 to 5-7-N). The statuses of the key switches on these bus lines ($N_1$ to $N_n$) are stored in memories (5-9-1 to 5-9-N) through gates (6-7-1 to 6-7-N), respectively. Based on desired priority determined by the structures of the gates (6-7-1 to 6-7-N) and OR gates (5-10-1 to 5-10-N), key closure signals "1" appearing on the bus lines ($N_1$ to $N_n$) are sequentially written in the memories (5-9-1 to 5-9-N) with clock pulses $\phi_2$ obtained by inverting the clock pulses $\phi_1$ with a NOT gate 5-3. While "1" is written in any one of the memories (5-9-1 to 5-9-N), "1" is fed to the gate 5-2 from that one of the OR gates (5-10-1 to 5-10-N) corresponding to the abovesaid memory, inhibiting the application of the clock pulse $\phi_1$ to the ring counter 5-1.

With the next clock pulse $\phi_2$, a key closure signal of the next priority is written in the corresponding one of the memories (5-9-1 to 5-9-N). Upon completion of write of the key closure signal, i.e. "1" in the memory after repetition of the abovesaid operation, the gate 5-2 is turned on to advance the ring counter 5-1 by one step with the clock pulse $\phi_1$. In this manner, when all keys on the corresponding one of the bus lines ($B_1$ to $B_N$) are closed, the ring counter 5-1 is advanced by one step with the clock pulse $\phi_1$. Thereafter, similar operations are carried out to detect the closed statuses of key switches on that one of the bus lines ($B_1$ to $B_N$) of the ring counter 5-1 on which "1" is provided and, in the case where one or more key switches in the key block of this bus line are closed, the operation of the ring counter 5-1 is stopped and the statuses of the closed switches are sequentially written in the memories (5-9-1 to 5-9-N) with the clock pulse $\phi_2$ in accordance with priority. After completion of detection of all the key closure signals, the ring counter 5-1 is actuated with the clock pulse $\phi_1$ to perform detection of the key block on the next bus line and, at each round of the ring counter 5-1, the frame synchronizing pulse FP indicative of one period of the block detection is derived from the line $B_1$.

Assuming that the key closure signals "1" are present on the bus lines $N_1$ and $N_2$ and the key closure signals "0" on the other bus lines $N_3$ to $N_n$, "0" is fed to the gate 6-7-1 via the OR gate 5-10-1 (the output from each of the memories (5-9-1 to 5-9-N) being "0"), so that "1" is applied to the memory 5-9-1. Since the output "0" from the abovesaid gate circuit 6-7-1 is supplied to the gate 6-7-2, "0" is applied to the memory 5-9-2. Since the gates (6-7-3 to 6-7-N) are respectively supplied with "0" of the bus lines $N_3$ to $N_n$, "0" is fed to each of the memories (5-9-3 to 5-9-N). Further, with the clock pulse $\phi_2$, "1" is written in the memory 5-9-1 and "0" in the other memories. When "1" is written in the memory 5-9-1, "1" is fed to the gate 6-7-1 through the OR gate 5-10-1, so that the output from the gate 6-7-1 becomes "0". Moreover, the output "1" from the OR gate 5-10-1 turns off the gate 5-2 to inhibit the application of the clock pulse $\phi_1$ to the ring counter 5-1.

With the next clock pulse $\phi_2$, "1" is written in the memory 5-9-2 and "0" in the other memories. When "1" is written in the memory 5-9-2, "1" is produced in each of the OR gates 5-10-2 and 5-10-1, deriving "0" from the gates 6-7-1 and 6-7-2. With the following clock pulse $\phi_2$, "0" is written in all of the memories (5-9-1 to 5-9-N). Then, the OR gate 5-10-1 provides an output "0" to turn on the gate 5-2, permitting the ring counter 5-1 to advance by one step with the clock pulse $\phi_1$. Thus, "1" is provided on the next but line to start the next key block detection.

Now, key switches of the same note are arranged on each of the bus lines $N_1$ to $N_n$. Namely, key switches of the note C are connected to the bus line $N_1$ and key switches of the note C# to the bus line $N_2$. In a similar manner, key switches of respective notes are respectively allocated to the other bus lines $N_3$ to $N_n$. On the bus lines ($B_2$ to $B_n$) there are respectively arranged octaves of upper, lower and pedal keyboards and the same octaves of the upper, lower and pedal keyboards are connected in common by OR gates (5-16-1 to 5-16-4), respectively. To each of the OR gates (5-16-1 to 5-16-4) is connected each octave line of the same key. The outputs from these OR gates are fed to a note encoder 5-4, an octave encoder 5-5 and a key encoder 5-6. With the encoders, the key closure signals are converted into key code signals (KCD) in the form of binary codes, and provided as a note code (NC), an octave code (OC) and a key code (KC), respectively.

Table 1 shows an example of each of the note code (NC), the octave code (OC) and key code (KC).

TABLE 1

| Note Code (NC) | Octave Code (OC) | Key Code (KC) |
|---|---|---|
| 0001 (C) | 001 ($OC_1$) | 01 (Upper keyboard) |
| 0010 (B) | 010 ($OC_2$) | 10 (Lower keyboard) |
| 0011 (A#) | 011 ($OC_3$) | 11 (Pedal keyboard) |
| 0100 (A) | 100 ($OC_4$) | |
| 0101 (G#) | 101 ($OC_5$) | |
| 0110 (G) | 110 ($OC_6$) | |
| 0111 (F#) | 111 ($OC_7$) | |
| 1000 (F) | | |
| 1001 (E) | | |
| 1010 (D#) | | |
| 1011 (D) | | |
| 1100 (C#) | | |

The outputs from the abovesaid encoders and the frame synchronizing pulses FP are applied to AND gates (5-11-1 to 5-11-4), (5-12-1 to 5-12-3) and (5-13-1 to 5-13-3), respectively, and gated by the clock pulses $\phi_2$ to be outputted in the form of key code signal KCD and the frame synchronizing pulse FP.

In accordance with this invention, as described above, a plurality of key switches disposed in a matrix circuit are divided into a plurality of blocks according to common lines and these common lines are connected in parallel with a ring counter and scanned with clock pulses like a ring counter. Where one or more key switches of one block are closed in the block being currently scanned, scanning is stopped immediately and the closed key switches are sequentially detected as key code signals by a priority detector in accordance with priority, which signals are encoded into binary codes and outputted together with a frame synchronizing pulse. In this instance, scanning skips over those blocks in which any of the key switches are not depressed and, in the block having a closed key switch or switches, scanning is carried out in accordance with priority. Consequently, the time for one scanning is limited only to scanning of the closed key switches. Further, since a maximum number of blocks which are simultaneously occupied is five, as described previously, a maximum amount of time necessary for scanning according to the method of this invention is dependent upon the sum of the abovesaid number of blocks, a maximum number of keys depressed and the frame synchronizing pulse. Accordingly, the time necessary for one scanning can be remarkedly shortened as compared with the time for scanning all key switches in the prior art. Moreover, the mount of wiring can be reduced, so that the problem of the number of pins in a semiconductor integrated circuit is eleminated, enabling easy fabrication of an integrated circuit.

Figure 3:
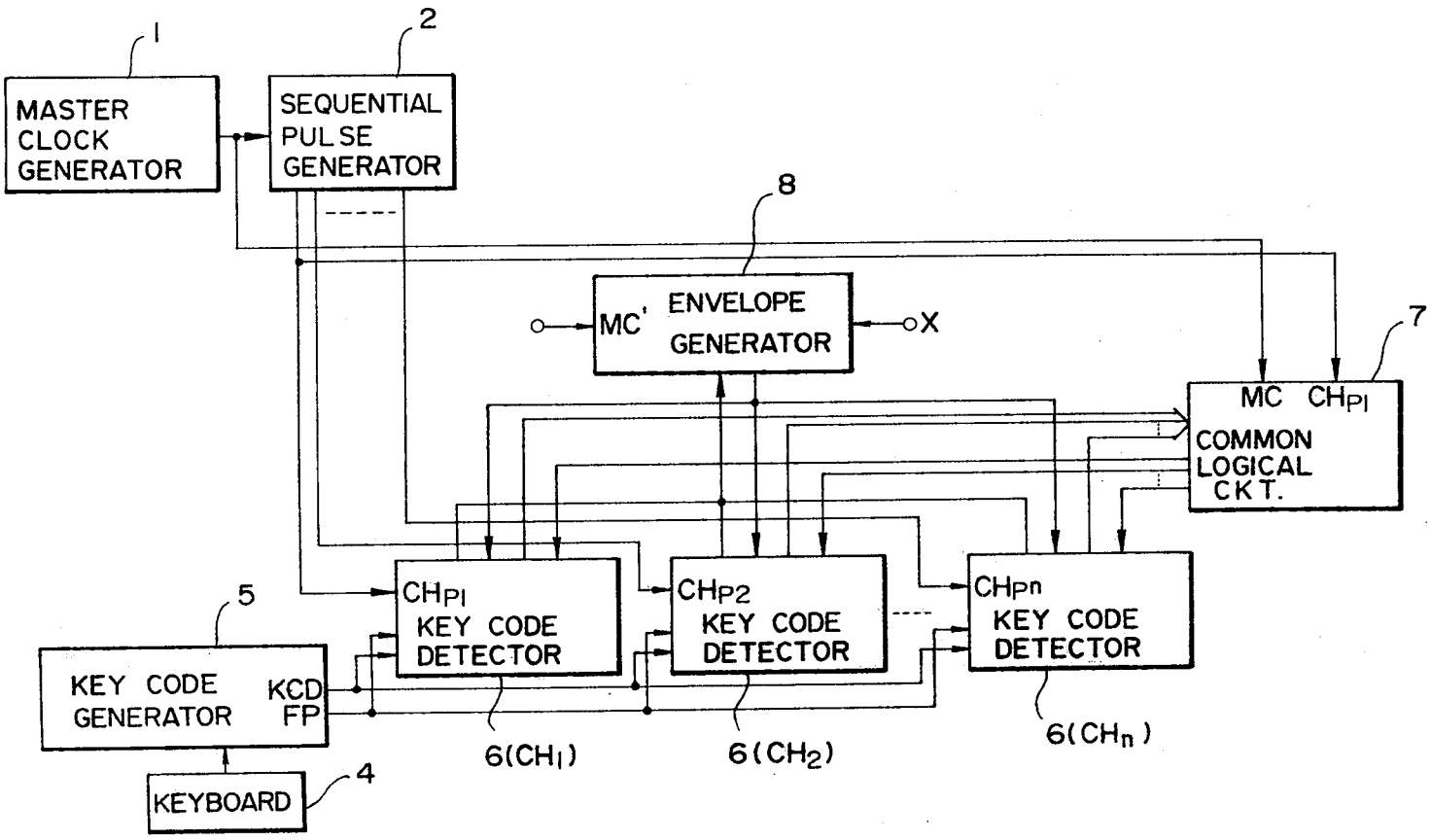
FIG. 3 is a block diagram illustrating the key code generator 5, a key code detector 6, a common logical circuit 7 and an envelope generator 8 depicted in FIG. 1.

FIG. 3 is a block diagram illustrating the key code detector 6 and the key code generator 5, the common logical circuit 7 and the envelope generator 8 which are closely related to the detector 6, in the FIG. 1 embodiment of this invention.

In FIG. 3, the key code signal (KCD) and the frame synchronizing signal (FP) derived from the key code generator 5 are applied to the key code detectors 6($CH_1$) to 6($CH_n$) or the respective channels. The key code detector 6 detects whether or not the key code signal KCD from the key code generator 5 is captured in its plurality of channels and whether or not the key corresponding to the captured key code signal is opened. The detected output is applied to the common logical circuit 7. In the common logical circuit 7, it is decided with the signals from the key code detectors 6($CH_1$) to 6($CH_n$) or respective channels whether the key code signal KCD be captured or not and, in the case of capture, the channel therefor is designated.

The key code detector 6 thus designated by the common logical circuit 7 seizes the key code signal KCD and, at the same time, starts counting of the envelope counter with that of sequential pulses ($CH_{p1}$ to $CH_{pn}$) from the sequential pulse generator 2 corresponding to the designated channel. The count value is time divided with the sequential pulse and then applied to the envelope generator 8 via a bus line. In the envelope generator 8, the envelope is always read out with the envelope master clock pulse MC' and the data corresponding to the abovesaid count value are read out from the envelope generator 8 through a gate. When the count value matches a set value X given to the envelope generator 8, the key code detector 6 is directed to stop the counting operation. Since a constant count value is thus applied to the envelope generator 8, constant data are read out at all times. Upon detection of key opening by the key code generator 6, the counting operation is resumed and the data corresponding to the count value are read out. When an envelope end signal is applied from the envelope generator 8 to the key code detector 6, the channel designated to seize the key code signal KCD is cleared in preparation for the next key code signal KCD.

With the above operation, a required envelope waveshape is read out and this envelope waveshape can be changed by changing the set value X.

Figure 4:
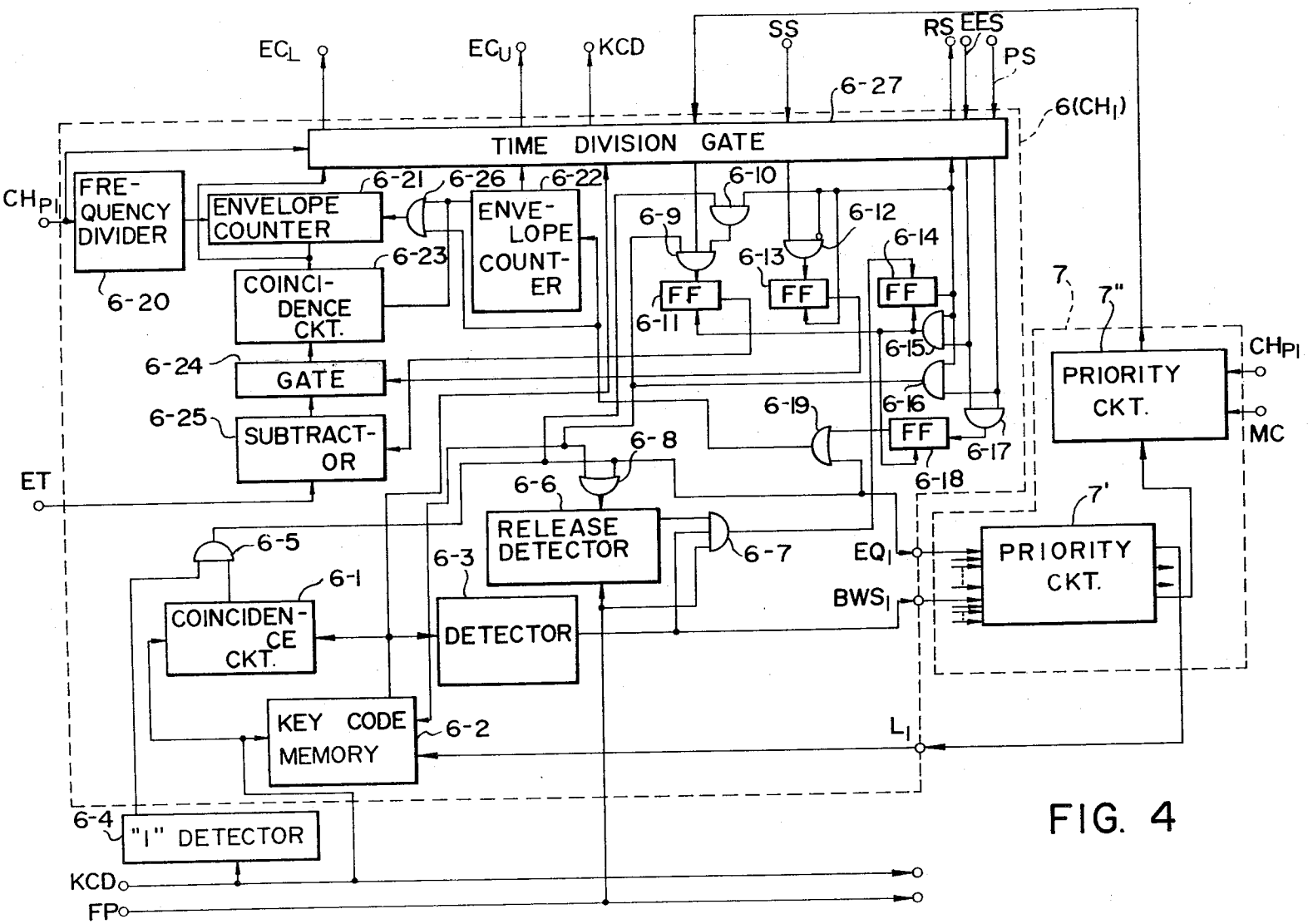
FIG. 4 shows the key code detector 6 ($CH_1$) depicted in FIG. 1.
Figure 5:
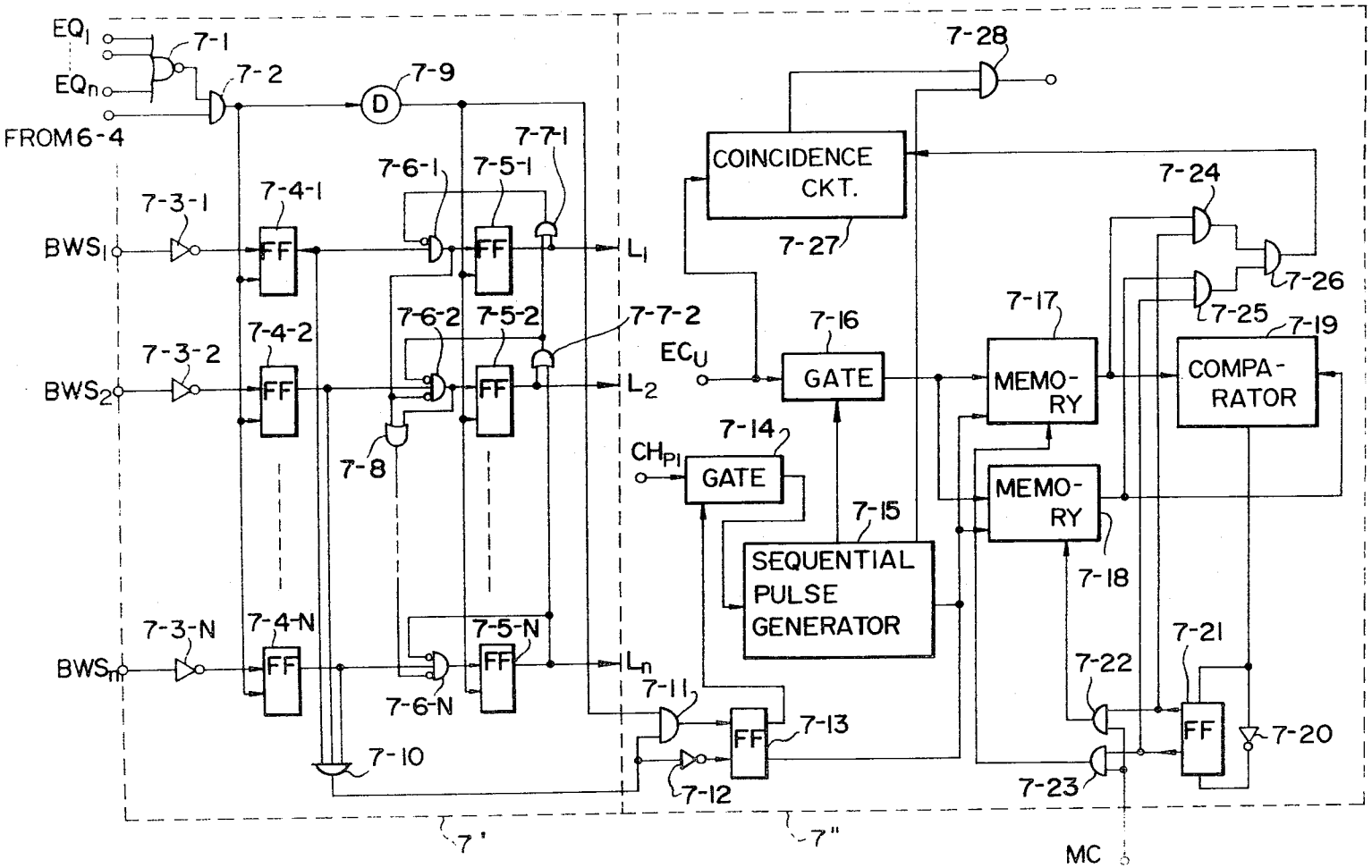
FIG. 5 illustrates the common logical circuit 7, which is shown to be composed of priority circuits 7' and 7''.

FIG. 4 is explanatory of the key code detector 6($CH_1$) and FIG. 5 the common logical circuit 7 composed of priority circuits 7' and 7''. The constructions and operations of the circuits shown in FIGS. 4 and 5 will be described with regard to (1) the case where a desired one of the key switches is closed, (2) the case where a key switch is closed after closure of the desired one, (3) the case where a closed key switch is opened and (4) the case where closure of a key switch occurs when all of the channels are occupied.

In the case of a desired key switch being closed, the following operations are carried out. In FIG. 4, the key code signal KCD from the key code generator 5 is fed to a "1" detector 6-4, from which "1" is applied to an AND circuit 6-5. A coincidence circuit 6-1 compares the content of a key code memory 6-2 with the key code signal KCD of the closed key switch to detect con-coincidence, providing "0". As a result of this, "0" is derived at an output $EQ_1$ of the AND gate 6-5. At the same time, detection takes place in the other channels and "0" is applied to each of inputs ($EQ_1$ to $EQ_n$) of a NOR gate 7-1 of the priority circuit 7' in FIG. 5, applying "1" to an AND gate 7-2.

Since the other input of the AND gate 7-2 is supplied with "1" from the "1" detector 6-4, the output from the AND gate 7-2 serves as a write signal for first memory flip-flops (7-4-1 to 7-4-N) of the priority circuit 7'. It is detected by a detector 6-3 whether the input signals to the first memory flip-flops (7-4-1 to 7-4-N) are stored in the key code memories 6-2 of all of the channels. Since $BWS_1$ to $BWS_n$ signals "0" are applied from the detectors 6-3 through NOT gates (7-3-1 to 7-3-N), "1" is written in all of the first memory flip-flops (7-4-1 to 7-4-N). The signals "1" written in the first memory flip-flops (7-4-1 to 7-4-N) are respectively supplied to gates (7-6-1 to 7-6-N). Since second memory flip-flops (7-5-1 to 7-5-N) have stored therein "0", the gate 7-6-1 is turned on and the other gates (7-6-2 to 7-6-N) off. The signal from the AND gate 7-2 is applied through a delay circuit 7-9 to generate a latch pulse $L_1$ in the key code memory 6-2 of the channel corresponding to the memory 7-5-1 when the signal "1" is written therein, thereby storing the key code signal KCD of the closed key switch in the key code memory 6-2. In this manner, the key code signal KCD of the closed key switch is stored in the channel determined by the priority circuit 7'.

In the next frame, a coincidence signal "1" is derived from the coincidence circuit 6-1 of the channel in which the key code signal is stored, and the output from the AND gate 6-5 is made "1". As a result of this, "1" is not derived from the NOR gate 7-1 and the priority circuit 7' does not operate, and consequently the same key code signal KCD is not seized in the other channels.

In the case where a key switch is closed after a desired one, the following operations take place. Namely, a new key code signal KCD is compared by the coincidence circuit 6-1 of each channel to provide a coincidence signal "0", deriving "1" from the NOR gate 7-1. The output "1" from the NOR gate 7-1 is applied as a write signal for each of the first memory flip-flops (7-4-1 to 7-4-N) via the AND gate 7-2. As the other input signals to the first memory flip-flops (7-4-1 to 7-4-N), the $BWS_1$ to $BWS_n$ signals from the detector 6-3 of the respective channels are applied via the NOT gates (7-3-1 to 7-3-N), and the input signal corresponding to the channel in which the key code signal KCD was previously stored, is "0". Let it be assumed that the input signal to the memory flip-flop 7-4-1 is "0". Then, the memory flip-flop 7-4-1 stores therein "0" and the other memory flip-flops (7-4-2 to 7-4-N) "1", respectively, by which the gate 7-6-1 is turned off and the gate 7-6-2 off. By turning on of the gate 7-6-2, the gate (7-6-3 to 7-6-N) disposed in the subsequent stages are turned off and, with the write signal delayed by the delay circuit 7-9, "1" is written in the second memory flip-flop 7-5-2 and "0" in all of the other second memory flip-flops. Thus, with the signal at the time of writing the signal "1" to the memory flip-flop 7-5-2, a new key code signal KCD is written in the key code memory 6-2 of the channel corresponding to the memory flip-flop 7-5-2.

Next, a description will be given in connection with the case where a closed key switch is opened. While the key code signal KCD is stored in the key code memory 6-2, a release detector (flip-flop) 6-6 is repeatedly set with the trailing edge of the frame synchronizing pulse FP, and reset with a reset signal applied via an OR gate 6-8 by turning on the AND gate 6-5 with the signals from the coincidence detector 6-1 and the "1" detector 6-4. Since the release detector 6-6 operates with the trailing edge of the frame synchronizing pulse FP, and remains in its reset state during the generation of the frame synchronizing pulse FP, an AND gate 6-7 is held in the off state while the reset pulse is applied to the release detector 6-6, although the detector 6-3 produces an output "1". When the key switch stored in the key code memory 6-2 is opened, no coincidence signal is derived from the coincidence detector 6-1 and the release detector 6-6 is not reset, so that after set by the frame synchronizing pulse FP, the release detector 6-6 produces an output to turn on the AND gate 6-7, through which a release status flip-flop 6-14 is set with the frame synchronizing pulse FP. The output from the release status flip-flop 6-14 is time divided by a time division gate 6-27 with the time division pulse $CH_{pn}$ of the corresponding channel to provide a release signal RS, which is transferred to the envelope generator 8 via a bus line. With this release signal RS, the corresponding envelope waveshape is shifted to a release status. An envelope end signal EES generated from the envelope generator 8 is seized by the time division gate 6-27 of the corresponding channel, resetting the release status flip-flop 6-14, the release detector 6-6 and the key code memory 6-2 via an AND gate 6-15. Thus, the channel is released from its occupied state in preparation for the next key code signal KCD.

Next, a description will be made in connection with the case where when all the channels are occupied, a key switch is further closed. In the case where a new key code signal KCD is applied to the NOR gate 7-1 of the priority circuit 7' of FIG. 5 through the AND gate 6-5 turned on by the coincidence detector 6-1 and the "1" detector 6-4 and the BWS signals (signals indicating that the key code signal is already stored) are applied all in the form of "0" from the key code memory 6-2 of all the channels to the NOT gates (7-3-1 to 7-3-N) to supply their outputs all in the form of "1" to the first memory flip-flops (7-4-1 to 7-4-N), "1" is applied to an AND gate 7-10, so that the new key code signal KCD fed through the delay circuit 7-9 sets an overflow memory flip-flop 7-13 via an AND gate 7-11 in the priority circuit 7''. Then, a gate 7-14 is turned on to apply the first channel pulse $CH_{pl}$ to a sequential pulse generator 7-15, enabling a gate 7-16. As a result of this, a high-order envelope count signal $EC_U$ of each channel, generated by an envelope counter 6-22 described later on, is fed to each of memories 7-17 and 7-18 via bus lines. The envelope count values $EC_U$ respectively stored in the memories 7-17 and 7-18 are applied to a comparator 7-19, from which the compared output is supplied to a flip-flop 7-21 to set and reset it. Its set and reset outputs are respectively connected to latch terminals of the memories 7-17 and 7-18 through AND gates 7-22 and 7-23, each having one input connected to the master clock generator 1. With this construction, the high-order envelope count values $EC_U$ of the respective channels transferred one after another in synchronism with the master clock pulse MC are compared and the high-order envelope count values $EC_U$ of new channels are stored in the memories having stored therein compared the smaller count value $EC_U$. After completion of comparison for all the channels, the sequential pulse generator 7-15 is actuated with the next channel pulse $CH_{pl}$, so that the gate 7-16 is turned off. A maximum value of the envelope count value $EC_U$ of each channel is indicated by the final state of the flip-flop 7-21, supplied with the output from the comparator 7-19, and that one of AND gates 7-24 and 7-25 corresponding to the maximum value is turned on to apply the maximum value to one input of a coincidence circuit 7-27 through an OR gate 7-26.

In FIG. 4, when a key switch is closed to produce the key code signal KCD, the priority circuit 7' of the common logical circuit 7 is actuated by the coincidence circuit 6-1 and the "1" detector 6-4 of each channel and when the key code signal KCD is stored in the key code memory 6-2 of top priority in which no key code signal is stored, the BWS signal of the detector 6-3 becomes "1" and the first and second envelope counters 6-21 and 6-22 are released from their reset state to start counting with a clock pulse that the corresponding channel pulse is frequency divided by a frequency divider 6-20 down to ½. The count value of the first envelope counter 6-21 is applied to one input of a coincidence circuit 6-23, to the other input of which is applied an envelope time set value ET through a subtractor 6-25 and a gate 6-24. With this arrangement, when the count value of the first envelope counter 6-21 matches the value fed from the gate 6-24, a coincidence signal is derived from the coincidence circuit 6-23 and applied through an OR gate 6-26 to the first envelope counter 6-21 to reset it and, at the same time, the coincidence signal is applied as an input signal to the second envelope counter 6-22. The count value of the first envelope counter 6-21 is time divided with the time dividing pulse of the corresponding channel in the time division gate 6-27 and a low-order envelope count value $EC_L$ is provided on a bus line. The count value of the second envelope counter 6-22 is also time divided by the time division gate and transferred as the high-order count value $EC_U$.

Since the envelope counters 6-21 and 6-22 perform counting with a period of two cycles of the time division clock pulse, the high-order envelope count value $EC_U$ applied to the coincidence circuit 7-27 in FIG. 5 transfers the same data in the respective channels during the operation of the sequential pulse generator 7-15. Upon arrival of a maximum value of the count value $EC_U$ via a bus line, the coincidence circuit 7-27 produces a coincidence signal, which is applied as a high-speed release signal HRS through an OR gate 6-20, the time division gate 6-27 and an OR gate 6-9 to a high-speed release flip-flop 6-11 to set it and its output is subtracted from the envelope time set value ET in the subtractor 6-25 to reduce the frequency dividing ratio of the first envelope counter 6-21, thereby providing the release status as high speed. Thus, when key switches larger in number than the channels are closed, a channel of the smallest amplitude of the envelope waveshape being produced is cleared in preparation for the latest key depression. Finally, when the overflow memory 7-13 is reset, the gate 7-14 is turned off to reset the sequential pulse generator 7-15 and the memories 7-17 and 7-18.

In FIG. 4, since a sustain status flip-flop 6-13, a percussive flip-flop 6-18 and gates associated therewith are not related to the gist of this invention, no description will be made of them.

As described above, according to this invention, in order to adapt the key code detector the key code generator which scans the blocks of key switches and the key switches only in the blocks having a closed key switch or switches to detect them to thereby provide for shortened scanning time, the key code detector detects whether or not the key code signal in KCD from the key code generator is seized in the plurality of channels and whether or not the key corresponding to the seized key code signal is opened, and the detected outputs are applied to the common logical circuit, which designates the channel for capturing the key code signal based on the signals from the key code detectors of the respective channels. Since the above functions can be performed simultaneously with scanning of the key code generator, a key code detector of excellent response can be realized and, in the cases of successive depression of the same key and depression of keys in excess of the number of channels, the key code detectors are selectively cleared at a predetermined speed, in accordance with the waveshape amplitude, so that no clear noise is produced.

Figure 6:
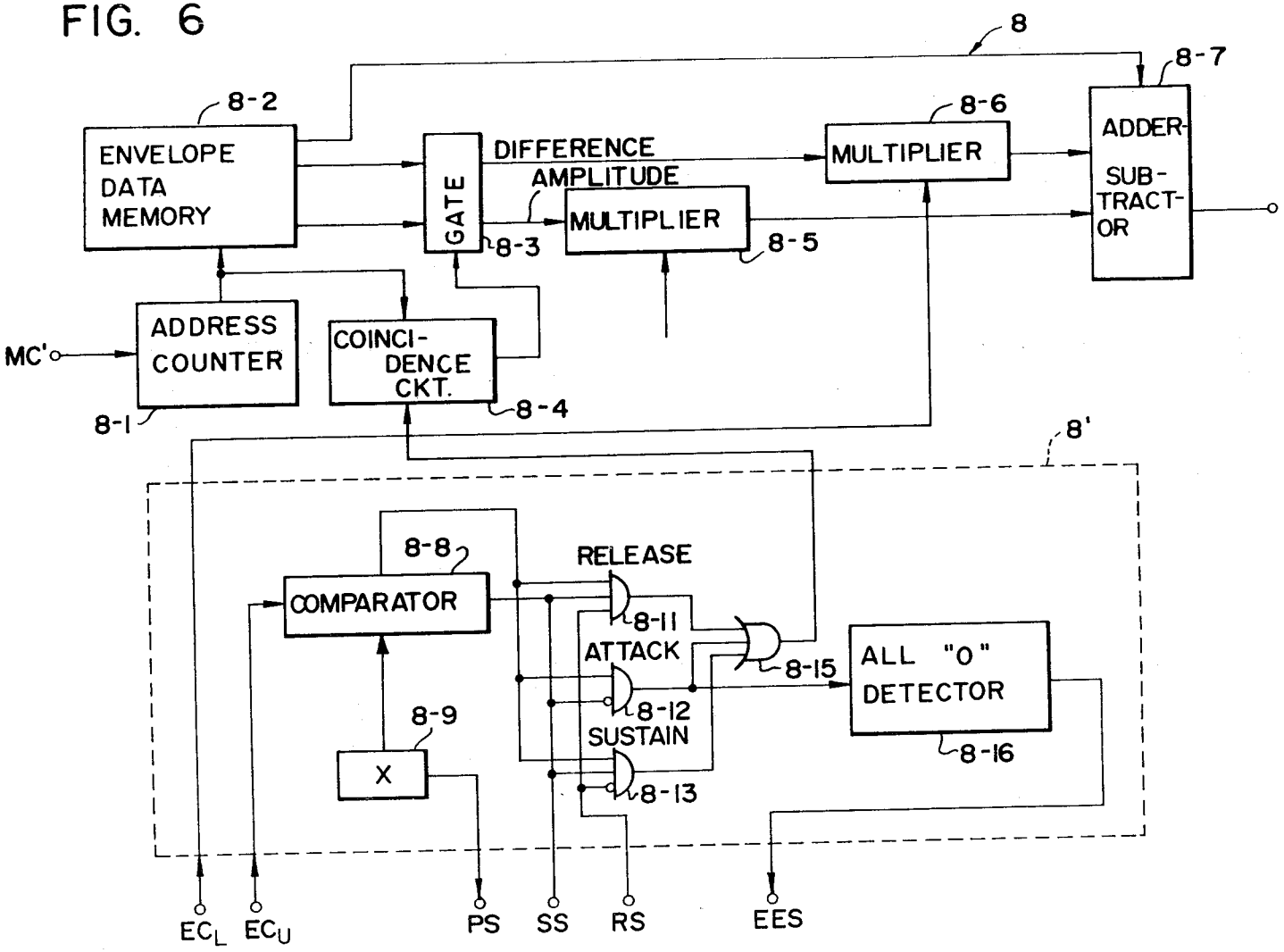
FIG. 6 is a detailed block diagram of the envelope generator 8 shown in FIG. 1.
Figure 7:
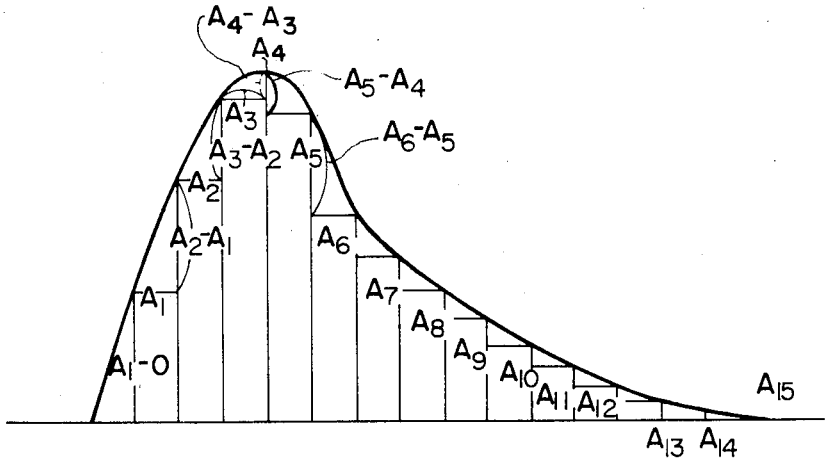
FIG. 7 shows quantized amplitude values for desired envelope waveshape data.

FIG. 6 illustrates in detail an example of the envelope generator 8 shown in FIG. 1. In FIG. 6, an address counter 8-1 is actuated with the envelope master clock pulse MC' to read out envelope data from an envelope data memory 8-2 at all times. The envelope data memory 8-2 has stored therein quantized amplitude values $A_1$ to $A_{15}$ of such desired envelope waveshape data as depicted in FIG. 7, difference values $A_0$-O, $A_2$-$A_1$, . . . between adjacent ones of the amplitude values $A_1$ to $A_{15}$ and sign bits S.B of the difference values. Table 2 shows the amplitude values, difference values and sign bits (S.B) for addresses $AD_0$ to $AD_{15}$ in the envelope data memory 8-2.

TABLE 2

| Amplitude value | Difference value | S.B | Address |
|---|---|---|---|
| 0 | 0 | 1 | $AD_0$ |
| 0 | $A_1$ | 1 | $AD_1$ |
| $A_1$ | $A_2 - A_1$ | 1 | $AD_2$ |
| $A_2$ | $A_3 - A_2$ | 1 | $AD_3$ |
| $A_3$ | $A_4 - A_3$ | 1 | $AD_4$ |
| $A_4$ | $A_5 - A_4$ | 0 | $AD_5$ |
| $A_5$ | $A_6 - A_5$ | 0 | $AD_6$ |
| $A_6$ | $A_7 - A_6$ | 0 | $AD_7$ |
| $A_7$ | $A_8 - A_7$ | 0 | $AD_8$ |
| $A_8$ | $A_9 - A_8$ | 0 | $AD_9$ |
| $A_9$ | $A_{10} - A_9$ | 0 | $AD_{10}$ |
| $A_{10}$ | $A_{11} - A_{10}$ | 0 | $AD_{11}$ |
| $A_{11}$ | $A_{12} - A_{11}$ | 0 | $AD_{12}$ |
| $A_{12}$ | $A_{13} - A_{12}$ | 0 | $AD_{13}$ |
| $A_{13}$ | $A_{14} - A_{13}$ | 0 | $AD_{14}$ |
| $A_{14}$ | $A_{15} - A_{14}$ | 0 | $AD_{15}$ |

In the case of effecting an envelope control by such digital processing, the envelope control can be achieved digitally which provides advantages such as a degree of freedom and an easy control of the envelope waveshape. However, it is apparent from FIG. 7 that in the case of digitally providing the envelope, when the musical amplitude is small at the start of attack, at the end of release, ets., quantization of a musical note becomes rough to destroy smooth attack and release. This problem can be overcome by an increase in the quantization number but this leads to an increase in the memory capacity and an increase in the number of signal bits used, introducing complexity in the construction of the system. Especially when the periods of attack and release are long, the abovesaid smoothness presents a problem.

In the block 8, the master clock MC′ applied to the block 8 is set such that the address counter 8-1 operates one cycle in one time slot of each of the time-divided clocks ($CH_{pl}$ to $CH_{pn}$) supplied to the block 6; consequently when the count value of the address counter 8-1 coincides with a signal fed to the coincidence circuit 8-4 from the block 8′, a coincidence signal is provided to the gate circuit 8-3, through which envelope date is read out from the envelope data memory 8-2. The present invention has for its object to reduce the storage capacity of the envelope data memory 8-2 and alleviate the generation of quantization noises by interpolation between successive sample values stored in the memory 8-2. The (broken-line) block 8′ in FIG. 6 is shown to have a 1-bit configuration for convenience of description; in practice, however, it is constructed to have a bit configuration corresponding to the envelope counter value $EC_u$.

The operation of the envelope generator of FIG. 6 will hereinbelow be described in relation to FIG. 4. The following description will be given on the assumption that the first and second envelope counters 6-21 and 6-22 are respectively 4-bit low-order and high-order envelope counters. If the envelope time set value ET and the set value which is applied to the coincidence circuit 6-23 through the subtractor 6-25, and the gate 6-24 are assumed to be "1111", the first envelope counter 6-21 serves as a 16-step counter to transfer the output therefrom as the low-order envelope count value $EC_L$ to a bus line through the time division gate 6-27. During one count of the second envelope counter 6-22, the first envelope counter 6-21 advances by sixteen steps. The high-order envelope count value $EC_U$ is applied to one input of a coincidence circuit 8-4 through an envelope control circuit 8′ of the broken-line block in FIG. 6. To the other input of the coincidence circuit 8-4 is applied the count value of the address counter 8-1, and when the high-order envelope count value $EC_U$ and the count value of the address counter 8-1 match each other, the coincidence circuit 8-4 produces a coincidence signal to enable a gate 8-3 to pass therethrough data of the amplitude value corresponding to the count value of the address counter 8-1 and the difference value to multipliers 8-5 and 8-6, respectively, and the sign bit (S.B) to an adder-subtractor 8-7. Since the first envelope counter 6-21 is considered to be 4-bit, the multiplier 8-5 performs a 16-time multiplication and applies the multiplied output to the adder-subtractor 8-7. The low-order envelope count value $EC_L$ is fed to the multiplier 8-6, and multiplied by the read out difference value. The multiplied output from the multiplier 8-6 is applied to the adder-subtractor 8-7, in which the multiplied outputs from the multipliers 8-5 and 8-6 are added with each other or subtracted one from the other in accordance with the sign bit. The flow chart of this calculation is shown in Table 3.

TABLE 3

| 2nd envelope count value $EC_U$ | Amplitude value | Difference value | S.B | 1st envelope count value $EC_L$ | Multiplier 8-5 output | Multiplier 8-6 output | Adder-subtractor 8-7 output |
|---|---|---|---|---|---|---|---|
| 0010 | $A_1$ | $A_2 - A_1$ | 1 | 0000 | $16A_1$ | 0 | $16A_1$ |
| 0010 | $A_1$ | $A_2 - A_1$ | 1 | 0001 | $16A_1$ | $(A_2 - A_1)$ | $16A_1 + (A_2 - A_1)$ |
| 0010 | $A_1$ | $A_2 - A_1$ | 1 | 0010 | $16A_1$ | $2(A_2 - A_1)$ | $16A_1 + 2(A_2 - A_1)$ |
| 0010 | $A_1$ | $A_2 - A_1$ | 1 | 0011 | $16A_1$ | $3(A_2 - A_1)$ | $16A_1 + 3(A_2 - A_1)$ |
| 0010 | $A_1$ | $A_2 - A_1$ | 1 | 0100 | $16A_1$ | $4(A_2 - A_1)$ | $16A_1 + 4(A_2 - A_1)$ |
| 0010 | $A_1$ | $A_2 - A_1$ | 1 | 0101 | $16A_1$ | $5(A_2 - A_1)$ | $16A_1 + 5(A_2 - A_1)$ |
| 0010 | $A_1$ | $A_2 - A_1$ | 1 | 0110 | $16A_1$ | $6(A_2 - A_1)$ | $16A_1 + 6(A_2 - A_1)$ |
| 0010 | $A_1$ | $A_2 - A_1$ | 1 | 0111 | $16A_1$ | $7(A_2 - A_1)$ | $16A_1 + 7(A_2 - A_1)$ |
| 0010 | $A_1$ | $A_2 - A_1$ | 1 | 1000 | $16A_1$ | $8(A_2 - A_1)$ | $16A_1 + 8(A_2 - A_1)$ |
| 0010 | $A_1$ | $A_2 - A_1$ | 1 | 1001 | $16A_1$ | $9(A_2 - A_1)$ | $16A_1 + 9(A_2 - A_1)$ |
| 0010 | $A_1$ | $A_2 - A_1$ | 1 | 1010 | $16A_1$ | $10(A_2 - A_1)$ | $16A_1 + 10(A_2 - A_1)$ |
| 0010 | $A_1$ | $A_2 - A_1$ | 1 | 1011 | $16A_1$ | $11(A_2 - A_1)$ | $16A_1 + 11(A_2 - A_1)$ |
| 0010 | $A_1$ | $A_2 - A_1$ | 1 | 1100 | $16A_1$ | $12(A_2 - A_1)$ | $16A_1 + 12(A_2 - A_1)$ |
| 0010 | $A_1$ | $A_2 - A_1$ | 1 | 1101 | $16A_1$ | $13(A_2 - A_1)$ | $16A_1 + 13(A_2 - A_1)$ |
| 0010 | $A_1$ | $A_2 - A_1$ | 1 | 1110 | $16A_1$ | $14(A_2 - A_1)$ | $16A_1 + 14(A_2 - A_1)$ |
| 0010 | $A_1$ | $A_2 - A_1$ | 1 | 1111 | $16A_1$ | $15(A_2 - A_1)$ | $16A_1 + 15(A_2 - A_1)$ |
| 0011 | $A_2$ | $A_2 - A_2$ | 1 | 0000 | $16A_2$ | 0 | $16A_2$ |

As is seen from Table 3, the amplitude value $A_1$ and the difference value $A_2$-$A_1$ stored in the envelope data memory 8-2 are applied through the gate 8-3 to the multipliers 8-5 and 8-6, respectively. In the multiplier 8-5, the amplitude value $A_1$ is multiplied by a multiplier value 16 determined by the four bits of the low-order envelope counter 21 and, in the multiplier 8-6, the difference value $A_2$-$A_1$ is multiplied by a multiplier value equal to the count value of the low-order envelope counter 21. And then, an addition or subtraction of the both multiplied outputs is achieved by the adder-subtractor 8-7 in accordance with the sign bit (S·B). That is, as shown in the column of the output from the adder-subtractor 8-7 in Table 3, fifteen data are inserted finely between $16A_1$ and $16A_2$. The envelope generator 8 is so controlled as to generate such a finely divided envelope in the attack and release statuses and a rough envelope based only on the high-order envelope count value at the stage of sustain, whereby a smooth envelope can be obtained without the necessity of increasing the memory capacity.

Figure 8A:
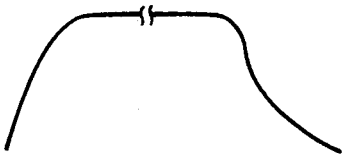
FIGS. 8A, 8B, 8C and 8D respectively show envelope waveshapes obtained in relation to a set value X of a circuit 8-9 depicted in FIG. 6 and an envelope count value $EC_U$.

The bit number of each of the first and second envelope counters 6-21 and 6-22 is assumed to be four in the present embodiment but even if the bit number is set as desired in accordance with the envelope time variation range and the word number of the envelope data memory 8-2, it is possible to control the data to be fine or rough. The high-order envelope count value $EC_U$ is supplied to one input of a comparator 8-8 in the envelope control circuit 8′. The comparator 8-8 is supplied at the other input with a set value X to provide "0" when $EC_U < X$ and "1" when $EC_U \geqq X$. If the amplitude value in FIG. 8A is assumed to be such that the address value "0101" corresponding to $A_4$ in FIG. 7 is provided as the set value X, an attack gate 8-12 is held in the on state until the high-order envelope count value $EC_U$ reaches the value "0101". The high-order envelope count value $EC_U$ is fed through an OR gate 8-15 to the coincidence circuit 8-4, which detects coincidence of the high-order envelope count value $EC_U$ with the count value of the address counter 8-1 to produce a coincidence signal, by which signal the envelope data from the envelope data memory 8-2 are transferred through the gate 8-3. When the high-order envelope count value $EC_U$ becomes equal to X(0101), the attack gate 8-12 is turned off. Further, the output "1" (a sustain signal SS) from the comparator 8-8 is seized by the corresponding channel through the time division gate 6-27, and applied to the gate 6-12. Since the release status flip-flop 6-14 is "0", the gate 6-12 sets a sustain status flip-flop 6-13, by which the gate 6-24 is turned off to apply "0" to the coincidence circuit 6-23. As a result of this, the first and second envelope counters 6-21 and 6-22 stop their operations when the count values reach "0000" and "0101", respectively. At this time, a sustain gate 8-13 is turned on to supply the high-order envelope count value $EC_U$ to the coincidence circuit 8-4 through the OR gate 8-15, with the result that data of the same address are successively read out to maintain the sustain status.

Next, a description will be made with regard to the case of opening of a key switch. While the key code signal KCD is stored in the key code memory 6-2, the release detector (flip-flop) 6-6 is repeatedly set with the trailing edge of the synchronizing pulse FP and reset with the reset signal fed through the OR gate 6-8 by turning on the AND gate 6-5 with the signals from the coincidence detector 6-1 and the "1" detector 6-4. When the key switch stored in the key code memory 6-2 is opened, no coincidence signal is derived from the coincidence detector 6-1 and the release detector 6-6 is no more reset. After set by the frame synchronizing pulse FP, the release detector 6-6 applies its output to the AND gate 6-7 to pass the frame synchronizing pulse FP to the release status flip-flop 6-14 to set it. As a result of this, the sustain status flip-flop 6-13 is reset to turn off the sustain gate 8-13 and on the gate 6-24.

Then, the first and second envelope counters 6-21 and 6-22 start counting and, at the same time, the condition of a release gate 8-11 is satisfied. The release gate 8-11 is turned on to apply therethrough the high-order envelope count value $EC_U$ through the OR gate 8-15, obtaining a release waveshape resulting from the opening of the key switch. After completion of the release status, the second envelope counter 6-22 returns to "0" after one cycle of its operation, turning on the attack gate 8-12. The count value "0" is detected by an all "0" detector 8-16 to produce the envelope end signal EES, which is seized by the time division gate 6-27 of the corresponding channel and fed to the AND gate 6-15. At this time, since the release status flip-flop 6-14 is in the set state, the release status flip-flop 6-14, the high-speed release flip-flop 6-11, the release detector 6-6 and the key code memory 6-2 are reset through the AND gate 6-15 to provide an empty channel in preparation for the next key switch closure.

Figure 8B:
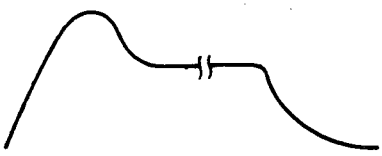
Figure 8C:
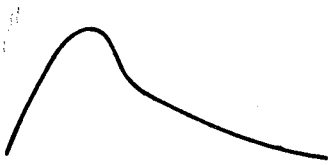

As described above, FIG. 8A shows an envelope waveshape in the case where the set value X is assumed to be "0101". Where the set value X is set such that X="0111", for example, the amplitude $A_7$ in FIG. 7 is set, providing such an envelope waveshape as shown in FIG. 8B which is especially featured by attack. In the case of an envelope waveshape of percussion shown in FIG. 8C, the set value X is so set as to satisfy the condition $X > EC_U$ at all times. Since this always satisfies the condition of the attack gate 8-12 for the high-order envelope count value $EC_U$, the attack gate 8-12 is maintained in the on state. At this time, a percussive control signal is detected by the all "0" detector 8-16 together with the set value X and applied to the AND gate 6-17 through the time division gate 6-27, setting a percussive flip-flop 6-18. The percussive flip-flop 6-18 releases the first and second envelope counters 6-21 and 6-22 from their reset state through the OR gate 6-19 and such a waveshape as shown in FIG. 8C is read out from the envelope memory 8-2 through the attack gate 8-12 together with the count value of the second envelope counter 6-22. After one round of the second envelope counter 6-22, its count value "0" is detected by the all "0" detector 8-16 to reset the percussive flip-flop 6-18 through the AND gate 6-17. As a result of this, the first and second envelope counters 6-21 and 6-22 are reset. When the release status flip-flop 6-14 is set simultaneously with the key switch opening, the release status flip-flop 6-14, the high-speed release flip-flop 6-11, the release detector 6-6 and the key code memory 6-2 are reset through the AND gate 6-15.

Figure 8D:
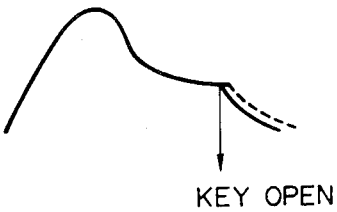

In the case where a key switch is closed during the generation of the percussive waveshape, as shown in FIG. 8D, the release status is rapidly terminated by the AND gate 6-16 and the OR gate 6-9. The AND gate 6-16 is supplied with a percussive control signal PS="1" and the output from the release status flip-flop 6-14 to set the high-speed release flip-flop 6-11 through the OR gate 6-9. Thus, the set value X is subtracted from the envelope time set value ET in the subtractor 6-25, thereby terminating the release status.

In the case where a key switch is closed during the attack status, the condition in the attack gate 8-12 is satisfied while the set value $X > EC_U$ and even if the release status flip-flop 6-14 is set, the attack gate 8-12 is held in the on state while the abovesaid condition is satisfied. When the set value $X \leqq EC_U$, the release gate 8-11 is turned on to provide such a waveshape as indicated by the broken line in FIG. 8D.

Where the key switch is closed again in the course of the release status, the release status flip-flop 6-14 in the set state is supplied with a coincidence signal from the coincidence circuit 6-14 through the AND gate 6-5 to turn on the AND gate 6-10, setting the high-speed release flip-flop 6-11 through the OR gate 6-9. As a result of this, the subtractor 6-25 operates to decrease the set value to be applied to the coincidence circuit 6-23, by which the release status is terminated and shifted to the attack status.

As set forth above, according to this invention, a desired envelope waveshape is stored in a memory and read out therefrom with a master clock pulse at all times. The read out content from the memory is counted by an envelope counter in synchronism with the master clock pulse based on a key code detected signal. And coincidence is detected by a coincidence circuit between the count value of the envelope counter and an address signal of the memory. This method simplifies the system construction and allows ease in control, as compared with the conventional system in which an envelope waveshape is generated upon each detection of a key code detected signal. Further, quantized amplitude values of the envelope waveshape, their difference values and sign bits are stored in a memory and a high-order and a low-order envelope counter are provided. And the amplitude value is multiplied by a multiplier value dependent upon the bit number of the low-order envelope counter and the difference value is multiplied by the count value of the low-order envelope counter. The both multiplied outputs are applied to an adder-subtractor for an addition or subtraction in accordance with the sign bit. Thus, it is possible to generate with a small number of memories an envelope waveshape which is smooth during attack and release and easy to control. Moreover, the envelope waveshape can be varied varriously by changing the set value X. The method of this invention is of particular utility when employed electronic musical instruments of digital processing.

Figure 9:
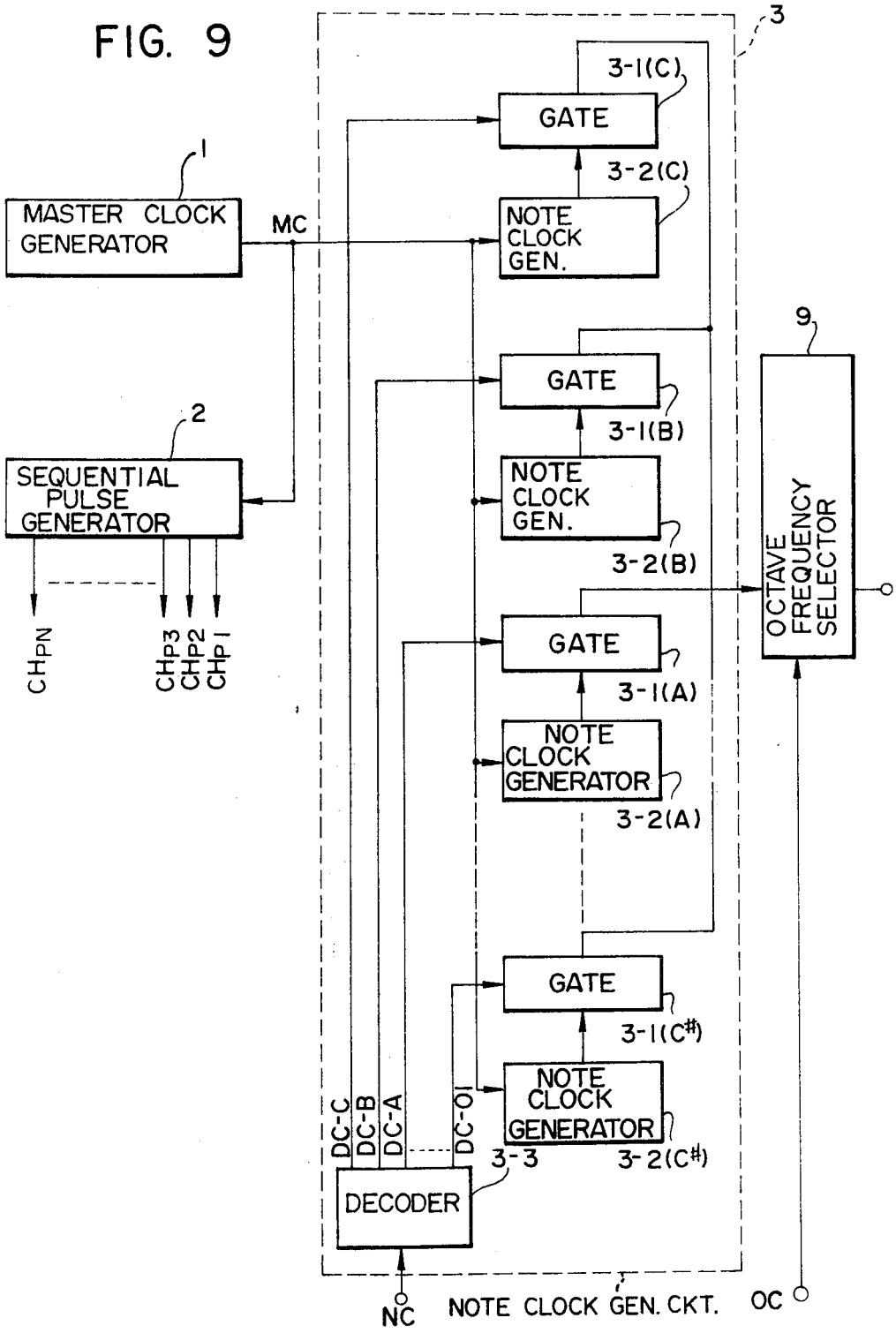
FIG. 9 is a block diagram illustrating a note clock generator 3 and an octave frequency selector 9 shown in FIG. 1.

FIG. 9 is a block diagram illustrating the note clock generator 3 and the octave frequency selector 9 in FIG. 1. In FIG. 9, the master clock pulse MC is applied from the master clock generator 1 to the note clock generator 3. The note clock generator 3 comprises twelve note clock generators 3-2(C) to 3-2(C#), each corresponding to one note. These note clock generators each have set therein a frequency dividing ratio determined by the master clock pulse MC, and oscillate at the frequency corresponding to the abovesaid note. The outputs of the note clock generators 3-2(C) to 3-2(C#).

In FIG. 1, the channel pulses ($CH_{p1}$ to $CH_{pn}$) from the sequential pulse generator 2 actuated with the master clock pulse MC from the master clock generator 1 are fed to the respective key code detectors 6($CH_1$) to 6($CH_n$). The note signals (NC), the octave signals (OC) and the key codes (KC) derived from each of the key code detectors are time divided by the corresponding channel pulses. The note signals NC thus time divided are applied to a decoder 3-3, from which they are each fed to the corresponding one of the note clock generators 3-2(C) to 3-2(C#) to turn on a gate. The note frequency signals applied to the octave frequency selector 9 via bus lines are respectively selected with the octave signals OC from the key code detectors 6 time-divided by the corresponding channel pulses, thereby selecting the frequencies corresponding to the octave signals OC, respectively.

Figure 10:
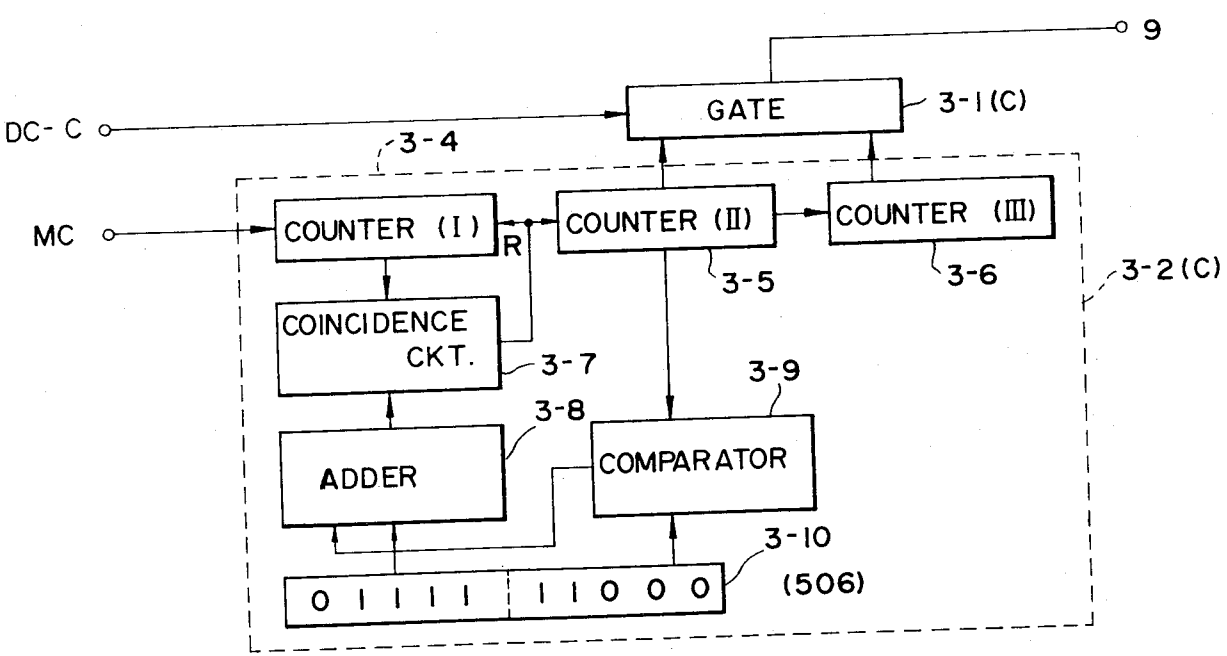
FIG. 10 is a detailed block diagram of a note clock generator 3-2(c) shown in FIG. 9.

FIG. 10 is a detailed block diagram of the note clock generator 3-2(C).

Table 4 shows frequency dividing ratios corresponding to notes $C_7$ to $C\#_6$ and cent errors indicative of the frequencies of the notes relative to standard frequencies in the case of the master clock pulse MC having a frequency of 1059.52 KHz.

TABLE 4

| Note | Frequency dividing ratio | Cent error |
|---|---|---|
| $C_7$ | 506 | +0.751 |
| $B_6$ | 536 | +1.037 |
| $A_6\#$ | 568 | +0.047 |
| $A_6$ | 602 | 0.000 |
| $G_6\#$ | 638 | −0.551 |
| $G_6$ | 676 | −0.721 |
| $F_6\#$ | 716 | −0.235 |
| $F_6$ | 758 | +1.079 |
| $E_6$ | 804 | −0.918 |
| $D_6\#$ | 852 | −1.368 |
| $D_6$ | 902 | −0.036 |
| $C_6\#$ | 956 | −0.697 |

In FIG. 10, the note clock generator 3-2(C) corresponding to the note C will be described by way of example. For instance, a binary code "0111111010" of the frequency dividing ratio 506 of the note $C_7$ is divided into high-order frequency information $F_U$ and low-order frequency information $F_L$, each having five bits, in the case where the word number n of each of the main memory circuits (I)10 and (II)11 described above in connection with FIG. 1 is selected to be 32. The high-order frequency information $F_U$="01111" (a decimal number 15) is applied to one input of an adder 3-8. Since the output from a comparator 3-9 is applied as the other input to the least significant digit of the adder 3-8, i.e. the digit "1", the adder 3-8 is supplied with "1" or "0" dependent upon whether the result of comparison of the count value $C_2$ of a second counter (II) 3-5 with the low-order frequency information $F_L$ is $C_2<F_L$ or $C_2 \geqq F_L$. Since the count value $C_2$ of the second counter (II) 3-5 has now an initial value "0" and since the low-order frequency information $F_L$="11010" (a decimal number 26) is applied to the comparator 3-9, "1" appears at the output of the comparator 3-9 because of the condition $F_L>C_2$. The output "1" from the comparator 3-9 is added by the adder 3-8 to the high-order frequency information $F_U$ and, as a result of this, "10000" (a decimal number 16) is applied to a coincidence circuit 3-7. The master clock pulse MC=1059.52 KHz from the master clock generator 1 is frequency divided by a first counter (I)3-4. Since the output from the first counter (I)3-4 is fed to the coincidence circuit 3-7, a coincidence signal is provided from the coincidence circuit 3-7 when the count value $C_1$ of the first counter (I)3-4 reaches "10000". The coincidence signal thus produced is applied to the first counter (I)3-4 to reset it and, at the same time, applied as an input signal to the second counter (II) 3-5. Then, until the count value $C_2$ of the second counter (II) 3-5 reaches "11010", the comparator 3-9 applies "1" to the adder 3-8, so that the coincidence circuit 3-7 produces a coincidence signal upon each occurrence of the 1/16 frequency division of the first counter (I) 3-4. When the count value $C_2$ of the second counter (II) 3-5 becomes larger than "11010", the output from the comparator 3-9 becomes "0", and consequently the adder 3-8 no more adds "1" to the coincidence circuit 3-7, outputting therefrom a coincidence signal upon each occurrence of 1/15 frequency division of the first counter (I) 3-4. Since the word number n of each of the main memory circuits (I) 10 and (II) 11 is set to be 32, the second counter (II) 35 is composed of five bits, i.e. five stages. After having reached a decimal number 31, the count value of the second counter (II) 35 returns to 0. Then, the above routine is iterated.

Thus, the master clock pulse MC is divided by the frequency dividing ratio 506 (see Table 4), into a total of 32 periods: namely, the number of 1/16 frequency division periods is 26 and that of 1/15 frequency division periods 6. One cycle of the second counter (II) 3-5 becomed the period of the note $C_7$. If the sound range is assumed to range from $C_1$ to $C_7$, the output from the second counter (II) 3-5 is frequency divided by a third counter (III) 3-6 of six bits. The outputs at the respective stages of the second and third counters (II) 3-5 and (III) 3-6, that is, a total of eleven bits $B_0$ to $B_{10}$: five bits of the counter (II) 3-5 and six bits of the counter (II) 3-6, are applied to the gate 3-1(C). Also, for the other notes, similar circuit constructions are employed. For processing the so-called "rounding error" based on a cent error for the frequency dividing ratio of the master clock pulse MC to become an integer, use is made of a variable frequency divider employing a combination of periods of two frequency dividing ratios whose divisors differ from each other by 1.

Assuming that the key code detector 6($CH_1$) of the first channel has seized a note signal (NC)="0001" and an octave signal (OC)="010" of the key code signal (KCD), the note signal NC="0001" time divided by the channel pulse $CH_{p1}$ is applied to the decoder 3-3. The note signal NC="0001" is decoded to turn on the gate 3-1(C) corresponding to the note C upon each occurrence of the channel pulse $CH_{p1}$.

The relationship between the decoder 3-3 and the note signal NC is shown in Table 5.

TABLE 5

| Note signal(NC) | Note | Decoder(3-3) output | Gate(3-1) | |
|---|---|---|---|---|
| 0001 | C | 1(line DC-C) | (C) | ON |
| 0010 | B | 2(line DC-B) | (B) | " |
| 0011 | A# | 3(line DC-A#) | (A#) | " |
| 0100 | A | 4(line DC-A) | (A) | " |
| 0101 | G# | 5(line DC-G#) | (G#) | " |
| 0110 | G | 6(line DC-G) | (G) | " |
| 0111 | F# | 7(line DC-F#) | (F#) | " |
| 1000 | F | 8(line DC-F) | (F) | " |
| 1001 | E | 9(line DC-E) | (E) | " |
| 1010 | D# | 10(line DC-D#) | (D#) | " |
| 1011 | D | 11(line DC-D) | (D) | " |
| 1100 | C# | 12(line DC-C#) | (C#) | " |

The gate 3-1(C) passes therethrough the respective bit outputs $B_0$ to $B_{10}$ from the second and third counters (II) 3-5 and (III) 3-6 to the octave frequency selector 9 via bus lines.

Figure 11:
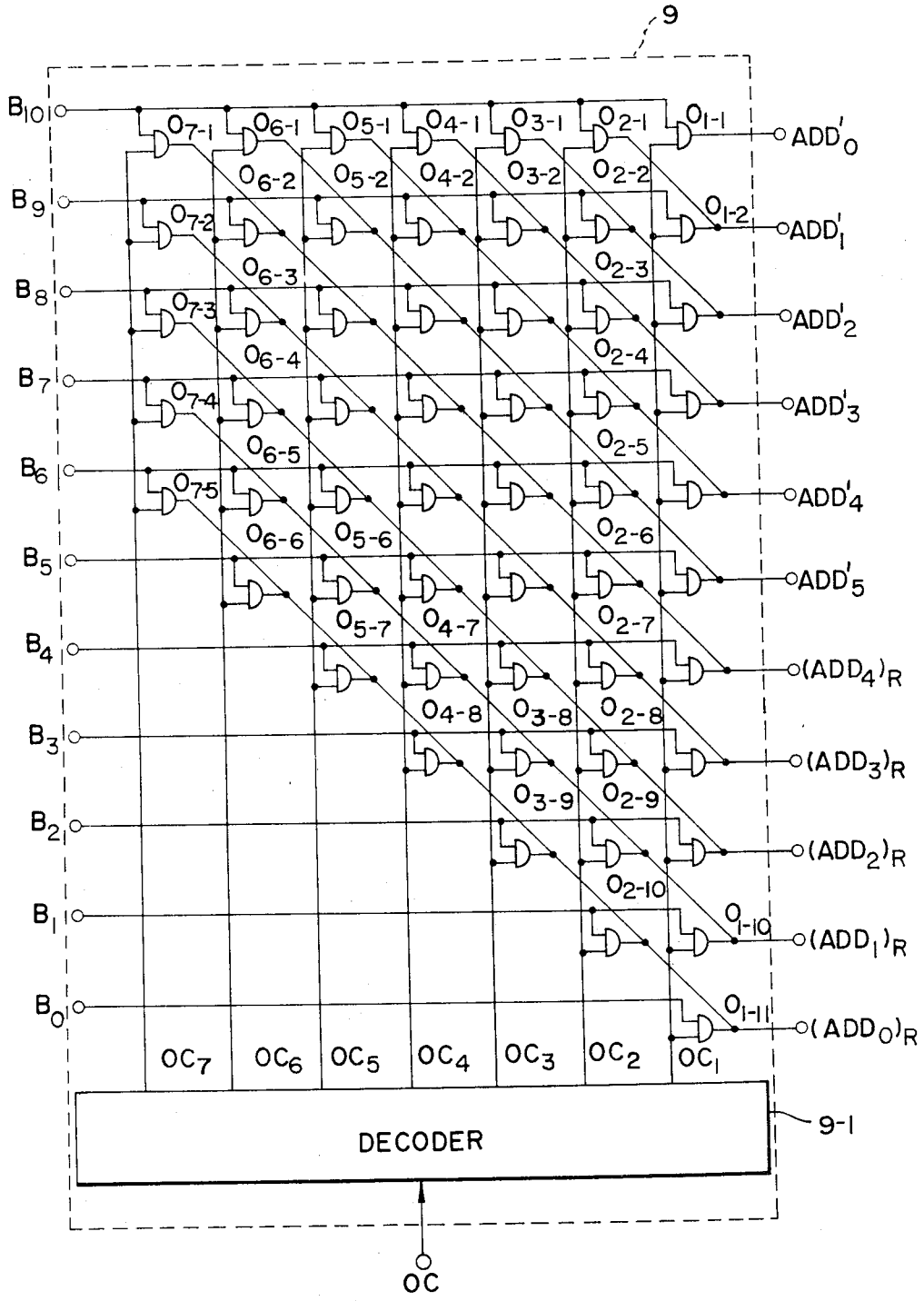
FIG. 11 is a detailed block diagram of the octave frequency selector 9.

FIG. 11 is a detailed block diagram of the octave frequency selector 9. In FIG. 11, a matrix circuit is formed with lines of terminals $B_0$ to $B_{10}$ and lines of octave signals $OC_1$ to $OC_7$ from the key code detectors 6 time divided by the channel pulses $CH_{p1}$ to $CH_{pn}$. The output from the matrix circuit is led out from the intersecting points of the both lines through diodes (not shown). For instance, when the octave signal OC="010" time divided by the channel pulse $CH_{p1}$ is applied to a decoder 9-1 to turn ON its output $OC_2$, AND gates $O_{2\text{-}1}$ to $O_{2\text{-}10}$ arranged on an output line $OC_2$ are turned on.

The octave frequency selector 9 changes over the address signals ($ADD_0$ to $ADD_4$)R of the main memory circuits (I) 10 and (II) 11 in FIG. 1 in accordance with such octave signals as shown in Table 6. The signals $B_1$ to $B_5$ are added by the octave signal OC="010" to the address signals ($ADD_0$ to $ADD_4$)R to obtain a frequency dividing ratio corresponding to the octave signal. The outputs $ADD'_0$ to $ADD'_5$ in the rightmost columm of Table 6 are applied to the complementor 14 shown in FIG. 1.

TABLE 6

| Octave signal (OC) | Decoder (9-1) output | Octave frequency | $ADD_0$ to $ADD_4$ output | $ADD'_0$ to $ADD'_5$ |
|---|---|---|---|---|
| 111 | $OC_7$ "1" | $C_7$-$C_6$# | $B_6$-$B_{10}$ | — |
| 110 | $OC_6$ "1" | $C_6$-$C_5$# | $B_5$-$B_9$ | $B_{10}$ |
| 101 | $OC_5$ "1" | $C_5$-$C_4$# | $B_4$-$B_8$ | $B_9$-$B_{10}$ |
| 100 | $OC_4$ "1" | $C_4$-$C_3$# | $B_3$-$B_7$ | $B_8$-$B_{10}$ |
| 011 | $OC_3$ "1" | $C_3$-$C_2$# | $B_2$-$B_6$ | $B_7$-$B_{10}$ |
| 010 | $OC_2$ "1" | $C_2$-$C_1$# | $B_1$-$B_5$ | $B_6$-$B_{10}$ |
| 001 | $OC_1$ "1" | $C_1$ | $B_0$-$B_4$ | $B_5$-$B_{10}$ |

The frequency information corresponding to the note signal NC and the octave signal OC from the key code detector 6 is derived from the output end of the octave frequency selector 9 during generation of the channel pulse corresponding to the key code detector 6.

As described above, a frequency is produced corresponding to the key information seized by the channel which is determined in accordance with a maximum number of simultaneously produced sounds in a key code detector. Since the frequency of a desired sound range is generated from a note clock generator by frequency dividing a signal from a main oscillator, there is no necessity of phasing which is needed in the prior art because of the provision of a variable frequency divider for each channel. Further, the use of a variable frequency divider corrects an error based on a cent error to ensure setting up of the period of a musical waveshape for each period and hence prevent jitter generation. Moreover, since the frequency information may be of a small number of digits, the memory capacity and the quantity of signal bits processed are small. Coupled with shortened scanning tines and simplified constructions of the key code generator and the key code detector, the above facts are very significant for electronic musical instruments.

Figure 12:
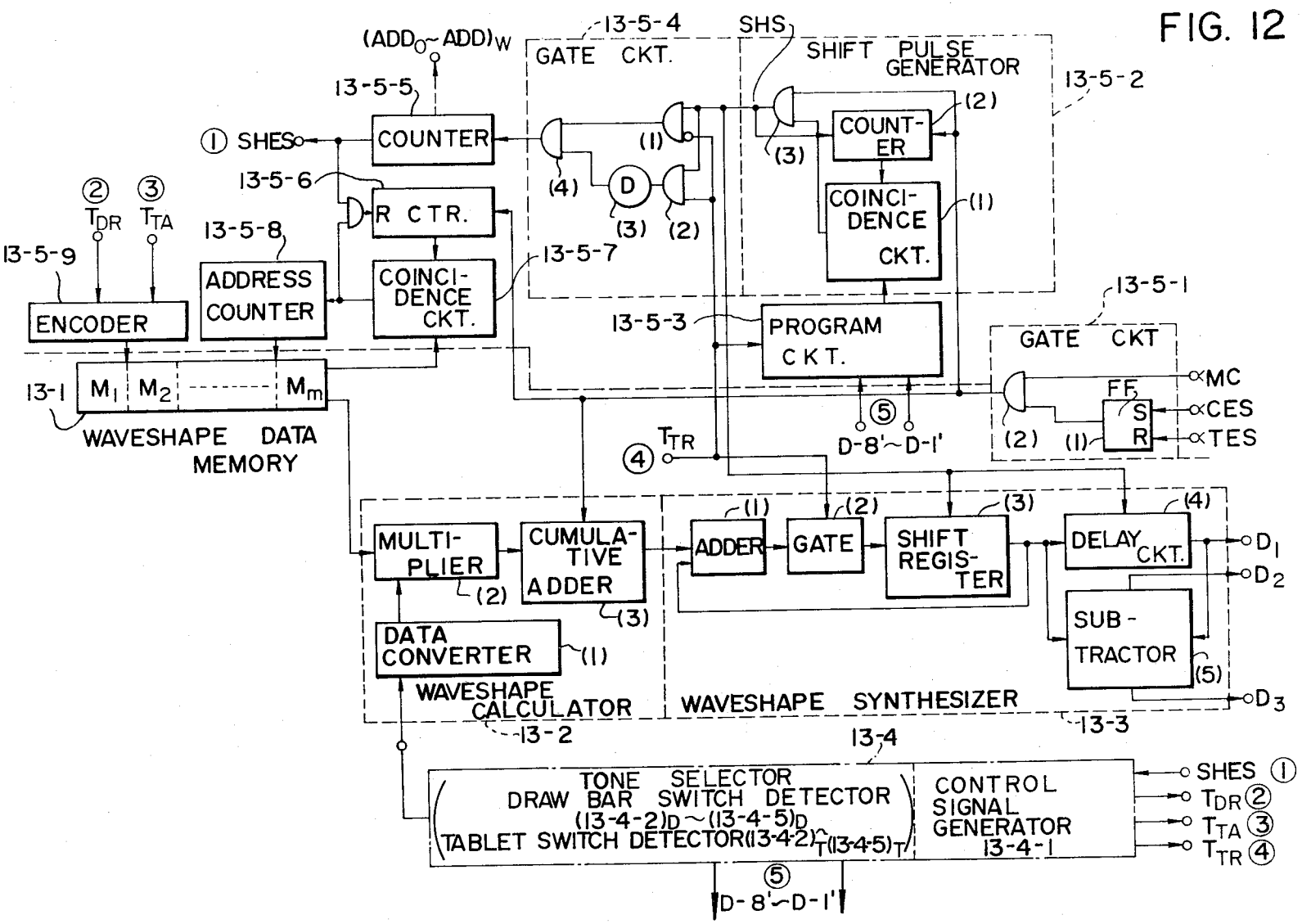
FIG. 12 is a detailed block diagram of a musical waveshape calculator 13 depicted in FIG. 1.
Figure 13:
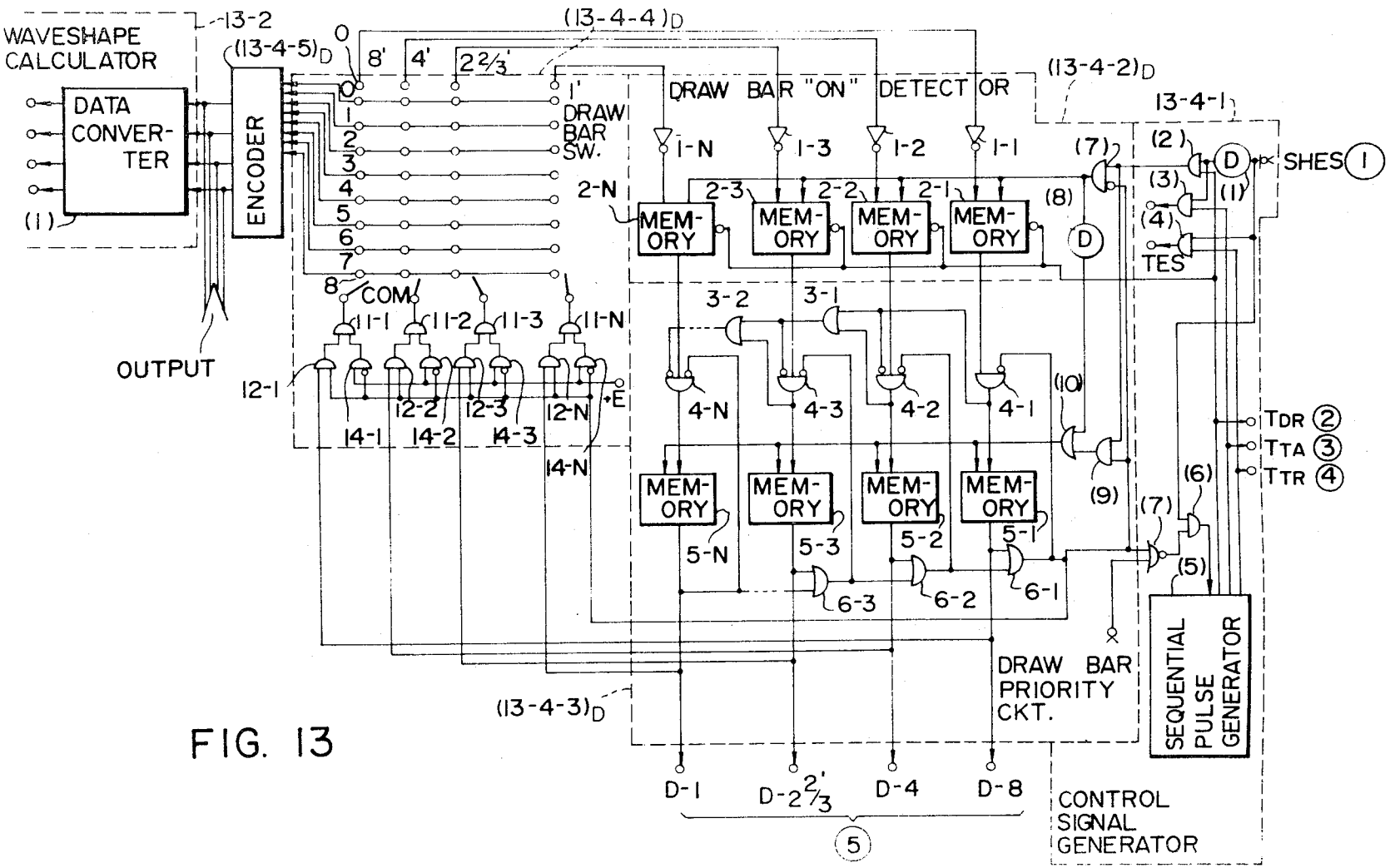
FIGS. 13 and 14 are detailed block diagrams of a draw bar switch detector and a tablet switch detector included in the musical waveshape calculator 13 of FIG. 12, respectively.
Figure 14:
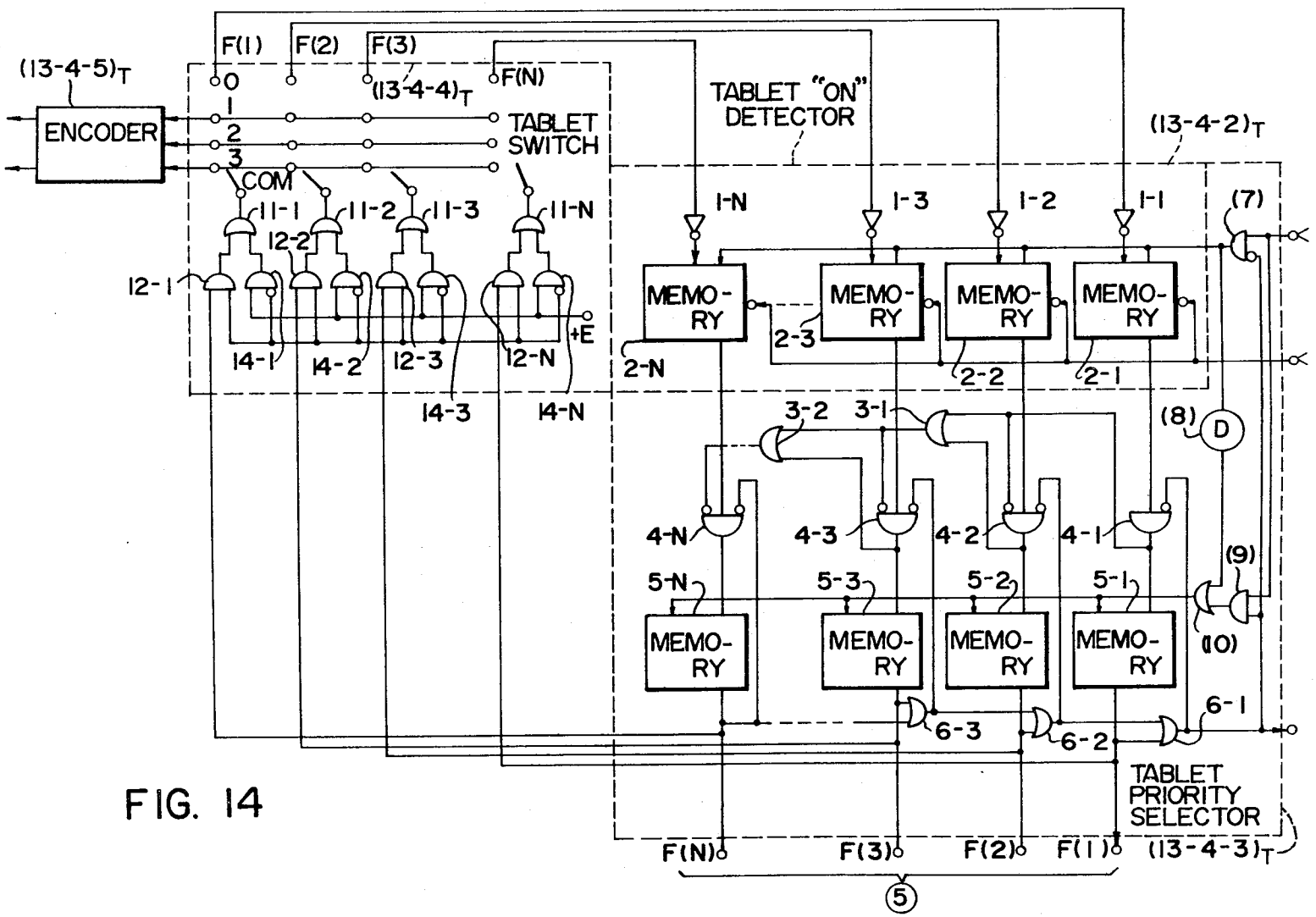

FIG. 12 is a detailed block diagram of the musical waveshape calculator 13 shown in FIG. 1. FIGS. 13 and 14 are detailed block diagrams of a draw bar switch detector and a tablet switch detector included in the musical waveshape calculator 13 depicted in FIG. 12.

In FIG. 12, upon generation of a synchronous detection end signal CES from the synchronous detectors 12A and 12B of the synchronous detector circuit 12 mentioned above in connection with FIG. 1, a flip-flop 13-5-1(1) of a gate 13-5-1 is set, so that the master clock pulse MC provided to a shift pulse generator 13-5-2 via an AND gate 13-5-1(2). In the shift pulse generator 13-5-2, a signal from a feet rate program circuit 13-5-3 corresponding to a feet rate is applied to one input of a coincidence circuit 13-5-2(1) and the count value of a counter 13-5-2(2) operative with the master clock pulse MC is applied to the other input of the coincidence circuit 13-5-2(1). Accordingly, when the count value of the counter 13-5-2(2) matches the value from the feet rate program circuit 13-5-3, the coincidence circuit 13-5-2(1) applies a coincidence output to one input of an AND gate 13-5-2(3). The AND gate 13-5-2(3) is supplied at the other input with the master clock pulse to select it corresponding to the feet rate, outputting a shift signal SHS. The counter 13-5-2(2) is reset with the trailing edge of the shift signal and, thereafter, a similar selection takes place until the value from the feet rate program circuit 13-5-3 changes. The relationship between the feet rate and the shift signal is shown in Table 7.

TABLE 7

| Feet rate | Relationship between shift signal (SHS) and master clock (MC) | Program circuit |
|---|---|---|
| 8' | 1:1 | 0000 |
| 4' | 1:2 | 0001 |
| 2⅔' | 1:3 | 0010 |
| 2' | 1:4 | 0011 |
| 1 3/5' | 1:5 | 0100 |
| 1⅓' | 1:6 | 0101 |
| 1' | 1:8 | 0111 |
| $T_{TR}$ | 1:1 | 0000 |

The shift signal SHS is applied to one input of each of a gate 13-5-4(1) and an AND gate 13-5-4(2) in the gate 13-5-4. The gate 13-5-4(1) and the AND gate 13-5-4(2) are supplied at the other input with a transmission cycle signal $T_{TR}$. During writing in the main memory circuits (I) 10 and (II) 11 from a musical waveshape synthesizer 13-3, the AND gate 13-5-4(2) is turned on to actuate a delay circuit 13-5-4(3), supplying therefrom an OR gate 13-5-4(4) with a shift signal SHS that the shift signal SHS is delayed by one bit. In a draw bar detection cycle $T_{DR}$ and a tablet detection cycle $T_{TA}$, the shift signal is applied to the OR gate 13-5-4(4) through the gate 13-5-4(1). The shift signal applied to the OR gate 13-5-4(4) is fed to a counter 13-5-5. The counter 13-5-5 is composed of 5 bits-32 words, and outputs a signal SHES ① at every 32 counts of the shift signal SHS. In the transmission cycle $T_{TR}$, the respective bit outputs from the counter 13-5-5 are provided as the address write signals ($ADD_0$ to $ADD_4$)W for writing in the main memory circuits (I) 10 and (II) 11.

The output signal SHES ① from the counter 13-5-5 is sent to a control signal generator 13-4-1 of a tone control 13-4 indicated by the one-dot chain line to indicate the abovementioned detecting cycles $T_{DR}$ ②, $T_{TA}$ ③ and $T_{TR}$ ④. At the same time, the output signal SHES ① is applied to a plurality of draw bar switch detectors or tablet switch detectors making up the tone control to detect switch ON signals following the priority of respective switches. These signals are applied to a waveshape calculator 13-2, and then feet rate signals (D-8' to D-1') ⑤ are fed to the feet rate program circuit 13-5-3. Now, a detailed description will be given of the control signal generator 13-4-1 and the draw bar switch detectors $(13\text{-}4\text{-}2)_D$ to $(13\text{-}4\text{-}5)_D$ with reference to FIG. 13 and the tablet switch detectors $(13\text{-}4\text{-}2)_T$ to $(13\text{-}4\text{-}5)_T$ with reference to FIG. 14.

The output signal SHES ① from the counter 13-5-5 is fed to the control signal generator 13-4-1 shown in FIG. 13, and thence to one input of each of AND gates 13-4-1(2), (3) and (4) through a delay circuit 13-4-1(1). The AND gates 13-4-1(2), (3) and (4) are each supplied at the other input with one output from a sequential pulse generator 13-4-1(5). The sequential pulse generator 13-4-1(5) is to designate the draw bar detection cycle $T_{DR}$ ②, the tablet detection cycle $T_{TA}$ ③ and the transmission cycle $T_{TR}$ ④. If the draw bar detection cycle $T_{DR}$ is designated, the output from the sequential pulse generator 13-4-1(5) is applied to the draw bar "ON" detector $(13\text{-}4\text{-}2)_D$ through the AND gate 13-4-1(2).

With the output "0" from an OR gate 6-1, a gate (7) is turned on and contacts 0 of the draw bar switches 8',4', . . . 1' of the draw bar switch detector $(13\text{-}4\text{-}4)_D$ are connected to memory circuits 2-1 to 2-N through NOT gates, respectively. At the same time, gates 14-1 to 14-N are turned on with the output "0" from the OR gate 6-1 to apply a voltage +E to common contacts COM. Accordingly, "0" or "1" is written by the output signal from the gate (7) in the memories 2-1 to 2-N depending upon whether the contacts 0 of the draw bar switches 8', 4', . . . 1' are in the on state or in the off state.

The outputs from the memories 2-1 to 2-N are fed to gates 4-1 to 4-N of a draw bar priority circuit $(13\text{-}4\text{-}3)_D$. Then, those of the draw bar switches which are disconnected from the contacts 0, that is, the draw bar switches in the on state, are written in memories 5-1 to 5-N by the signal SHES applied through a delay circuit (8) and an OR gate (10) based on priority set by the AND gates 4-1 to 4-N, OR gates 3-1 and 3-2 and 6-1 to 6-N. At this time, "1" is provided to the OR gate 6-1 to turn off the gate (7) and on a gate (9).

During generation of the signal SHES ①, while the OR gate 6-1 is supplied with "1", the draw bar switches which are sequentially turned on are selected. The outputs D-8' to D-1' ⑤ from the memories 5-1 to 5-N are fed to the feet rate program circuit 13-5-3, supplying the shift pulse generator 13-5-2 of FIG. 12 with such signals as shown in Table 7 corresponding to the feet rates of the draw bar switches stored in the memories 5-1 to 5-N. On the other hand, a draw bar detection cycle signal $T_{DR}$ ② is applied to an encoder 13-5-9 to designate a corresponding one of waveshape data blocks of the waveshape data memory 13-1 having stored therein waveshape data $M_1$ to $M_m$, respectively. The waveshape data are as follows:- namely, a sine waveshape is divided into a desired number of periods and each period is represented by a linear function, and each waveshape data block has stored therein time information t indicative of the period number and a coefficient A. With the master clock pulse MC from the gate 13-5-1, a counter 13-5-6 starts counting, and the information t from the waveshape data memory 13-1 and the count value of the counter 13-5-6 are compared by a coincidence circuit 13-5-7 with each other. With a coincidence signal from the coincidence circuit 13-5-7, an address counter 13-5-8 is actuated to sequentially assign addresses in the designated waveshape data block to read out therefrom the waveshape data. At this time, by a signal "1" from the OR gate 6-1 of the draw bar priority circuit $(13\text{-}4\text{-}3)_D$ described above with respect to FIG. 13, the gates 14-1 to 14-N are turned on. The outputs (D-8' to D-1') ⑤ from the memories 5-1 to 5-N are applied to OR gates (11-1 to 11-N) through the gates (14-1 to 14-N) in the on state, detecting the contact positions where the draw bar switches outputting "1" are connected to the COM contacts on the lines (D-8' to D-1'). The detected outputs are applied to an encoder $(13\text{-}4\text{-}5)_D$. The output from the encoder $(13\text{-}4\text{-}5)_D$ is data converted by a data converter 13-2(1) of the waveshape calculator 13-2 and the output therefrom is applied to a multiplier 13-2(2) of the waveshape calculator 13-2 in which it is multiplied by the coefficient A read out of the waveshape data memory 13-1, and the multiplied output is fed to an accumulator 13-2(3). The accumulator 13-2(3) is controlled by the master clock pulse MC to convert the input thereto into a musical wavechape based on the period infromation t and the coefficient A. A concrete example of the relationship between the contact positions of the draw bar switches and the tablet switches and the level conversion is shown in Table 8.

TABLE 8

| Tablet switch | Draw bar switch | dB | Coefficient |
|---|---|---|---|
| 0 | 0 | $-\infty$ | 0 |
| * | 1 | −21 | 0.089 |
| * | 2 | −18 | 0.1259 |
| * | 3 | −15 | 0.1778 |
| * | 4 | −12 | 0.2512 |
| * | 5 | −9 | 0.3548 |
| 3 | 6 | −6 | 0.5012 |
| 2 | 7 | −3 | 0.7079 |
| 1 | 8 | 0 | 1.0 |

The musical waveshape from the accumulator 13-2(3) is applied to the waveshape synthesizer 13-3. The waveshape synthesizer 13-3 comprises an adder 13-3(1), a gate 13-3(2) and a shift register 13-3(3). The shift register 13-3(2) is supplied with the shift signal SHS from the shift pulse generator 13-5-2. The shift signal SHS and the master clock pulse MC bear such a relation as shown in Table 7. In the accumulator 13-2(3), one period of the waveshape of each feet rate is calculated with 32 words equal to the count value of the counter 13-5-5. The shift signal SHS of 8 feet and the master clock pulse MC have a relation of 1:1 to each other. The musical waveshape calculated by the accumulator 13-2(3) is sequentially stored in the shift register 13-3(3) through the adder 13-3(1) and the gate 13-3(2). The gate 13-3(2)

is held in the on state except during the transmission cycle $T_{TR}$.

Upon completion of one cycle of writing in the shift register 13-3(3), the signal SHES is derived from the counter 13-5-5 and the next detection of the draw bar switches in the on state is achieved by the draw bar priority circuit (13-4-3)$_D$. Let it be assumed that a draw bar of 4 feet is in the on state. In this instance, since the shift signal SHS and the master clock pulse MC bear a relation of 1:2 to each other and since alternate ones of the musical waveshape calculated by the accumulator 13-2(3) is sequentially written in the shift register 13-3(3), the signal SHES is derived from the counter 13-5-5 for the first time after two cycles of calculation of the accumulator 13-2(3). Accordingly, a musical waveshape of two periods is written in the shift register 13-3(3). In the case of $2\frac{2}{3}$ feet, a musical waveshape of three periods is written and, in the case of 2 feet, a musical waveshape of two periods. The newly written musical waveshape is added by the adder 13-3(1) to the previous musical waveshape to provide a complex musical waveshape, which sequentially written in the shift register 13-3(3). Thereafter, the draw bar switches in the on state are sequentially detected and the newly written musical waveshape is added to the previous one at the level set by the detected draw bar and the complex waveshape is written in the shift register 13-3(3). Upon completion of the draw bar switch detection, "0" is fed from the OR gate 6-1 to one input of a NOR gate (7) of the control signal generator 13-4-1. Since the NOR gate (7) is supplied at the other input with "0" from the tablet priority circuit (13-4-3)$_T$, an AND gate (6) is turned on, through which the sequential pulse generator 13-4-1(5) is advanced by one step with the signal SHES, initiating to the tablet detection cycle.

Also in the tablet detector, as shown in FIG. 14, the tablet switches are detected in the same manner as the draw bar switches. The outputs F(1) to F(N) from memories (5-1 to 5-N) are applied to the encoder 13-5-9 to assign that of the blocks of the waveshape data memory 13-1 which correspond to the detected tablet switch. At the same time, the outputs F(1) to F(N) from the memories (5-1 to 5-N) are also applied to the feet rate program circuit 13-5-3 to generate a shift signal SHS of the corresponding feet rate from the shift pulse generator 13-5-2. Then, in the multiplier 13-2(2), the level corresponding to the detected tablet switch position is multiplied by the coefficient A from the waveshape data memory 13-1 and, in the accumulator 13-2(3), the multiplied output is converted into a musical waveshape. The musical waveshape is applied to the waveshape synthesizer 13-3 in which it is combined with a previously stored waveshape to provide a complex waveshape, which is then stored in the shift register 13-3(3). Upon completion of detection of all tablet switches in the on state in the tablet detection cycle $T_{TA}$, the sequential pulse generator 13-4-1(5) is advanced by one step and the tablet detection cycle shifts to the transmission cycle $T_{TR}$. Thus, in the draw bar detection cycle $T_{DR}$ and the tablet detection cycle $T_{TA}$, the complex waveshape that the musical waveshape corresponding to all of the tablet switches and draw bar switches in on state is calculated by the waveshape synthesizer 13-3 at the designated levels, is stored in the shift register 13-3-3(3). In the transmission cycle $T_{TA}$, "1" is applied to the feet rate program circuit 13-5-3 to supply the shift pulse generator 13-5-2 with the signal corresponding to 8 feet, deriving a shift signal SHS from the shift pulse generator 13-5-2. The shift signal SHS is fed to the AND gate 13-5-4(2) to turn it on and delayed by one bit by the delay circuit 13-5-4(3), thereafter being applied to the counter 13-5-5 through the OR gate 13-5-4(4). With the shift signal SHS applied to the shift register 13-3(3) from the shift pulse generator 13-5-2, starting of counting of the counter 13-5-5 is delayed by one bit.

The gate circuit 13-3(2) of the waveshape synthesizer 13-3 is turned off by the transmission cycle signal $T_{TR}$ and the shift register is sequentially read out by the shift signal SHS and the read output is applied to a 1-bit delay circuit 13-3(4). The input signal to the delay circuit 13-3(4) and the output signal therefrom are fed to a subtractor 13-3(5), in which the output signal from the delay circuits 13-3(4) is subtracted from the input signal thereto to provide a difference value $D_2$. Further, a sign bit $D_3$ for the difference value $D_2$ is also derived from the subtractor 13-3(5). Moreover, the output signal from the delay circuit 13-3(4) is provided as an amplitude value $D_1$. Together with these musical waveshape data, the address write signals ($ADD_0$ to $ADD_4$)W from the counter 13-5-5 are transferred to the main memory circuit (I) 10 and (II) 11. After completion of the transfer, a transmission cycle end signal TES is generated from an AND gate 13-4-1(4) of the control signal generator 13-4-1 by the signal SHES from the counter 13-5-5 and, at the same time, the sequential pulse generator 13-4-1(5) is shifted to the draw bar detection cycle $T_{DR}$.

By resetting the flip-flop 13-5-1(1) of the gate 13-5-1 with the transmission cycle end signal TES, the AND gate 13-5-1(2) is turned off, inhibiting application of the master clock pulse MC to any circuits. Then, the operation is stopped until the signal CES is applied from the synchronous detectors 12A and 12B.

As described above, a required musical waveshape is divided into a desired number of periods, the divided waveshapes are represented by desired functions and the respective divided period numbers indicated by the functions and coefficient values are stored in a memory. Therefore, as compared with the conventional system in which the amplitude values of a desired musical waveshape at its sampling points are stored, the memory capacity used can be remarkedly decreased. Further, since musical waveshapes of different feet rates can be stored with the same memory capacity, memory readout is simplified.

Figure 15:
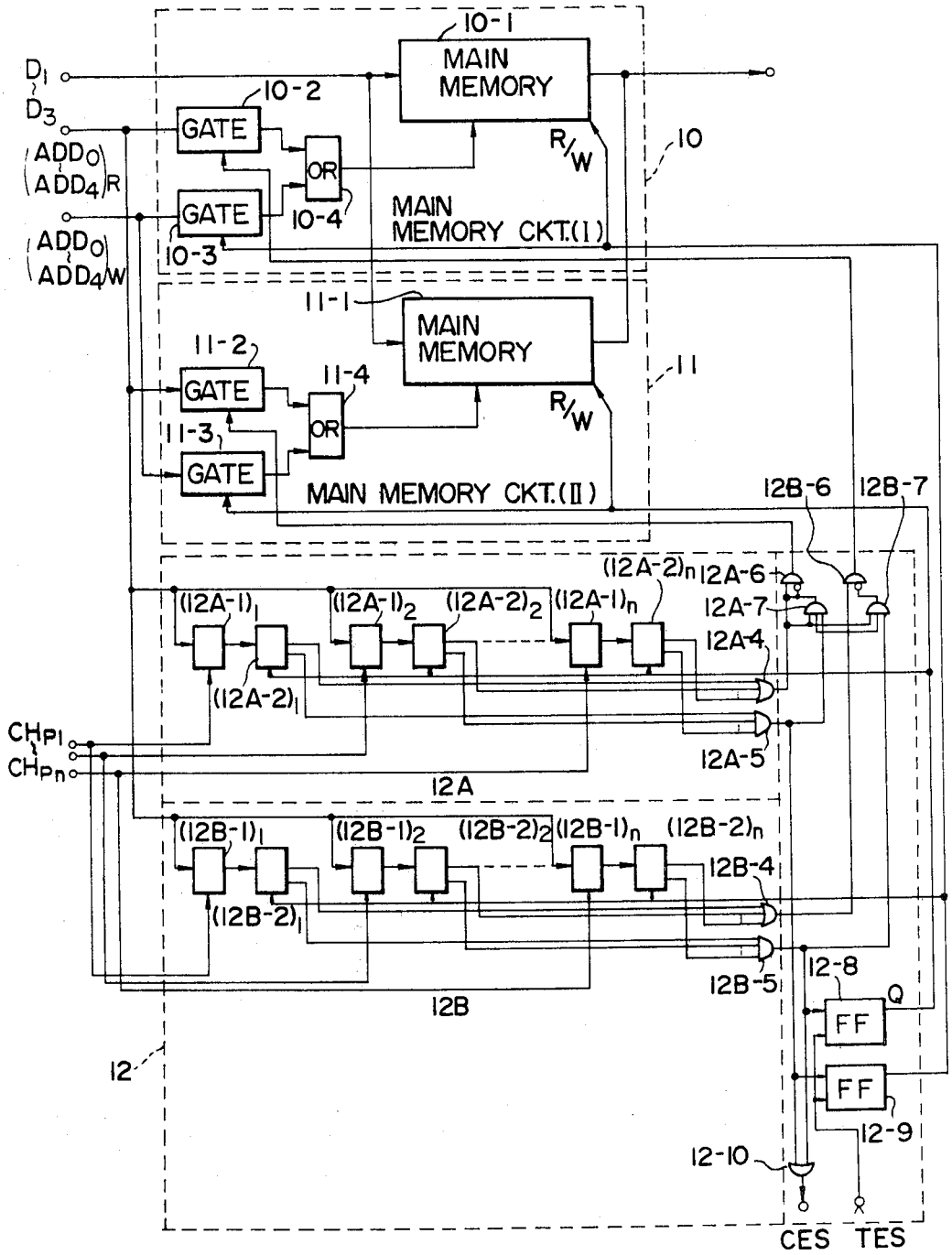
FIG. 15 is a detailed block diagram showing main memory circuits (I) 10 and (II) 11 and a synchronous detector 12 depicted in FIG. 1.

FIG. 15 illustrates in block form the main memory circuits (I) 10 and (II) 11 and the synchronous detector 12 shown in FIG. 1.

In FIG. 15, when "1" is derived from an AND gate 12B-5 by the output from the synchronous detector 12B which constitutes the synchronous detector circuit 12 together with the other synchronous detector 12A, a flip-flop 12-8 is set and, at the same time, a synchronous detection end signal CES is produced from an OR gate 12-10. When supplied with the signal CES, the musical waveshape calculator 13 detects those of the key switches of the draw bar switch and the tablet switch of the tone control which are in the on state. And in the draw bar detection cycle $T_{DR}$ and in the tablet detection cycle $T_{TA}$, respective waveshapes are calculated and combined into complex waveshapes and, in the transmission cycle $T_{TR}$, the musical waveshape data $D_1$, $D_2$ and $D_3$ and the address write signals ($ADD_0$ to $ADD_4$)W are transmitted to the main memory circuits (I) 10 and (II) 11.

In this case, since the flip-flop 12-8 is in its set state, the write signal W is applied to a main memory 11-1 and, at the same time, the gate 11-3 is turned on. That is, the address write signals ($ADD_0$ to $ADD_4$)W are applied to the main memory 11-1 through the gate 11-3 and an OR gate 11-4 to write the musical waveshape data $D_1$, $D_2$ and $D_3$ in the main memory 11-1. After completion of this write, the flip-flop 12-8 is reset by the transmission cycle end signal TES from the musical waveshape calculator 13. Then, the synchronous detector 12A is released from its reset state in which it was held during the set state of the flip-flop 12-8, and put in the set state to start detection of address read signals ($ADD_0$ to $ADD_4$)R transferred from the octave frequency selector 9 through a bus line.

The addresses "0" of the time-divided address read signals ($ADD_0$ to $ADD_4$)R are detected by the channel pulses $CH_{p1}$ to $CH_{pn}$ is all "0" detectors $(12A\text{-}1)_1$ to $(12A\text{-}1)_n$, each provided for one channel, and the detected outputs are applied to period detectors $(12A\text{-}2)_1$ to $(12A\text{-}2)_n$, respectively. In each of the period detectors $(12A\text{-}2)_1$ to $(12A\text{-}2)_n$, one period of each channel is detected by detecting the address "0" signal which arrives after a certain period of time set by the address "0" signal detected first.

Figure 16:
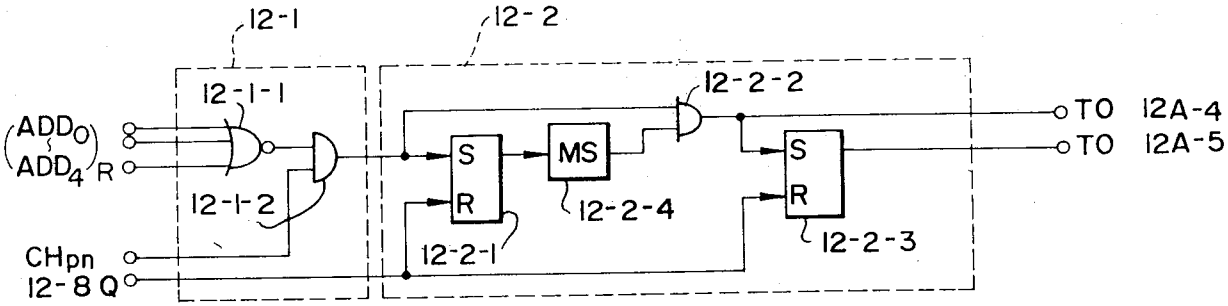
FIG. 16 is a block diagram illustrating an example of a detailed circuit construction composed of an all "O" detector and a period detector depicted in FIG. 15.

Detailed examples of the all "0" detector and the period detector are shown in FIG. 16. In FIG. 16, the address "0" of the address read signal ($ADD_0$ to $ADD_4$)R is detected by a NOR gate 12-1-1, and selected by the channel pulse $CH_{pn}$ of the corresponding channel through an AND gate 12-1-2, setting a flip-flop 12-2-1 in a period detector 12-2. With shifting of the flip-flop 12-2-1 to the set state, a monostable multivibrator 12-2-4 is actuated to turn off an AND gate 12-2-2. As a result of this, during the operation of the monostable multivibrator 12-2-4, the address "0" detected by the all "0" detector 12-1 is always turned off by the AND gate 12-2-2. The address "0", detected after completion of the operation of the monostable multivibrator 12-2-4, sets a flip-flop 12-2-3. The output signal Q from the flip-flop 12-2-3 is applied to an AND gate 12A-5 and, at the same time, the output signal from the AND gate 12-2-2 is fed to an OR gate 12A-4. The operation time of the monostable multivibrator 12-2-4 is set to be longer than the time for the address read signal ($ADD_0$)R in the period of the lowest musical note. While the flip-flop 12-8 is set, the abovesaid state is maintained and upon resetting of the flip-flop 12-8, the flip-flops 12-2-1 and 12-2-3 are reset.

The channel pulses $CH_{p1}$ to $CH_{pn}$ of the channels that one period has been detected, provided from the OR gate 12A-4, are each applied to a gate 12A-6 through an AND gate 12A-7, and then applied to a gate 11-2 of the main memory circuit (II) 11. Then, the address read signal ($ADD_0$ to $ADD_4$)R are fed through the OR gate 11-4 to the main memory 11-1 to start readout. In this manner, one period of each channel is detected by the corresponding one of the period detectors $(12A\text{-}2)_1$ to $(12A\text{-}2)_n$ and the main memory having stored therein new musical waveshapes is read out sequentially in the channels thus detected.

In the channel in which the key is closed, since the address "0" signal is transferred upon each occurrence of the channel pulses $CH_{pl}$ to $CH_{pn}$, the one-period detection is achieved at high speed. It is inhibited by the AND gate 12B-7 to read out the main memory 10-1 prior to the main memory 11-1. The AND gate 12B-7 is supplied with the output signals from the OR gates 12A-4 and 12B-4 and the AND gate 12B-5. Accordingly, when the channel pulses of the same channel are provided from the OR gates 12A-4 and 12B-4, since the output from the AND gate 12B-5 of the synchronous detector 12B effecting readout of the main memory 11-1 earlier than the synchronous detector 12A is "1", an inhibit signal is applied from the AND gate 12B-7 to the gate circuit 12B-6 to turn it off. Thus, simultaneous readout of the two main memory circuits (I) 10 and (II) 11 in one channel is inhibited. After the read signals ($ADD_0$ to $ADD_4$)R from the main memory circuit (I) 10 are transferred to the main memory circuit (II) 11, i.e. after readout and transfer of the musical signal, "1" is derived from the AND gate 12A-5 to set the flip-flop 12-9 to apply the write signal W to the main memory circuit (I) 10. At the same time, the synchronous detection end signal CES is fed through the OR gate 12-10 to the musical waveshape calculator 13 to instruct it to calculate a new musical waveshape. The musical waveshape, calculated by the musical waveshape calculator 13 in the draw bar detection cycle $T_{DR}$ and in the tablet detection cycle $T_{TA}$, is written in the main memory circuit 10-1 through a gate 10-3 and an OR gate 10-4 in the transmission cycle $T_{TR}$ and the flip-flop 12-9 is reset. At the same time, the synchronous detector 12B performs a detection similar to the abovesaid one, by which the main memory circuit (II) 11 is read out into the main memory circuit (I) 10 having sequentially stored therein new musical waveshape in the channels that one period has been detected.

The musical waveshape is generated from the main memory circuit (II) 11 during writing in the main memory circuit (I) 10, and still generated from the main memory circuit (I) 10 during writing in the main memory circuit (II) 11. Accordingly, a change in the musical waveshape caused by the operation of the tone control does not exert any influence on the musical waveshape generation. Further, since the period detection of different musical waveshapes are achieved by the synchronous detector circuits $(12\text{-}2)_1$ to $(12\text{-}2)_n$ connected in parallel relation, the detection is effected in a short time and a change in the musical waveshape is also performed instantly.

In the above, the synchronous detection has been described in the case where one period is used as one unit period of the detection but this depends on the tablet detection cycle, the draw bar detection cycle, the transmission cycle and the highest frequency of a musical waveshape desired to obtain and, needless to say, a plurality of periods can also be used as one unit period of the detection.

In the block 12, if, now a stored musical waveshape is read from the main memory 10-1, a new musical waveshape accompanying a change of a tone control device is calculated and written in the main memory 10-1. In the synchronization detector 12, the address "0" of the channel pulse ($CH_{p1}$ to $CH_{pn}$) is detected from the address bus ($ADD_0$ to $ADD_4$)R for each channel, and the address bus gate 11-2 is turned ON upon each detection to start reading of the main memory 11-1 having stored therein the new musical waveshape. By the same operation, reading for all of the channels is switched to the main memory 11-1, thus making the main memory 10-1 ready for calculation of a new musical waveshape. When the new musical waveshape is calculated it is written in the main memory 10-1, and by the same operation is described above, reading is switched to the main memory 10-1. As a consequence, conversion of a musical waveshape has no influence on generation of a subsequent musical waveshape, and a rapid response to the conversion of the musical waveshape can be achieved.

As set forth above, while a first memory circuit is read out based on key closure, a new musical waveshape resulting from the operation of a tone control is written in a second memory circuit and the content from the first memory circuit from the calculator 13 is read out in synchronism with the read-out period. After completion of writing in the second memory circuit from the calculator 13, a new musical waveshape by the operation of the tone control is written in the first memory circuit. In this manner, conversion of a musical waveshape controlled by the tone control, that is, writing of the musical waveshape in the memory circuit from a musical waveshape calculator, and the musical waveshape generation, that is, readout of the memory circuit, are achieved completely separately of each other in terms of time and circuitry. Consequently, there is no possibility that the musical waveshape conversion affects the musical waveshape generation. Further, by such parallel detection of the musical note period as described above, an electronic musical instrument can be realized which is excellent in the response to the musical waveshape conversion.

As described previously in connection with FIGS. 12, 13 and 14, according to this invention, in a single or a plurality of series of tone selectors, each composed of draw bar switches, tablet switches, etc., predetermined detection cycles are provided and key switches are selectively stored and only these switches are sequentially scanned in accordance with preset priority, whereby musical waveshapes can be changed over. This enables tone switching among the series of tone selectors and in each series of tone selectors, and hence provides a variety of tone changes. Further, since the closed switches stored in the memory circuit are scanned in accordance with priority as described, a rapid response can be obtained and the construction is simplified as compared with the conventional system of the type scanning all switches, and the number of connections is reduced, which is suitable for fabrication of an integrated circuit. Moreover, at the time of changing over the switches or the tone controls, they are completely isolated from each other electrically, so that they do not affect each other and no noise is generated.

Figure 17:
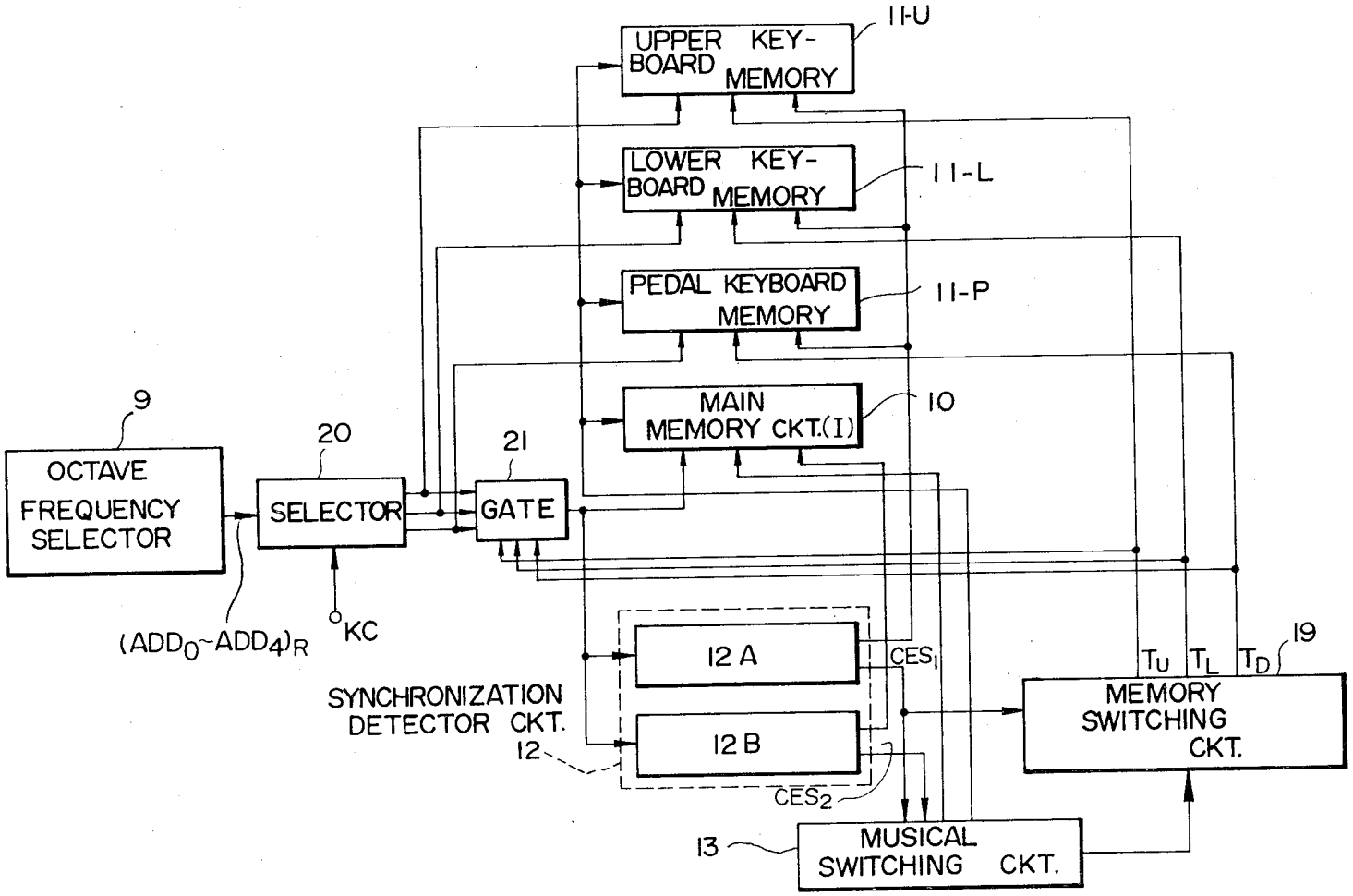
FIG. 17 is a block diagram showing an example of the electronic musical instrument of FIG. 1 in which a main memory circuit is provided for each keyboard and a coupler mechanism is provided between the keyboards.

FIG. 1 is explanatory of the outline of the electronic musical instrument of the system of this invention but in the case of embodying this invention, it is possible to provide a main memory circuit for each of the upper keyboard, the lower keyboard and the pedal keyboard and a coupler mechanism between adjacent ones of them, as shown in FIG. 17.

FIG. 17 illustrates another embodiment of this invention which is constructed based on the same principle as in the case of a single keyboard depicted in FIG. 1. That is, the main memory circuit (II) 11 is divided into an upper keyboard memory 11-U, a lower keyboard memory 11-L and a pedal keyboard memory 11-P. A musical waveshape is transferred by the synchronous detection of the synchronous detector 12 from each memory to the main memory circuit (I) 10. Each memory is directed by a memory switching circuit 19. The memory switching circuit 19 changes over the abovesaid memories in the order, for example, an upper keyboard waveshape reload cycle $T_U$, a lower keyboard waveshape reload cycle $T_L$ and a pedal keyboard waveshape reload cycle $T_P$ by a period detection end signal $CES_1$ from the synchronous detector 12A.

When the signal $CES_1$ is derived from the synchronous detector 12A, a complex musical waveshape of the upper keyboard is written in the main memory circuit (I) 10 in the transmission cycle after the draw bar switch and tablet switch detection cycles in the musical waveshape calculator 13. At this time, write in the main memory circuit (I) 10 is instructed in the memory switching circuit. The address read signals ($ADD_0$ to $ADD_4$)R applied from the octave frequency selector 9 to a selector 20 at this time are selected by the key code KC provided via an address bus line from the key code detector 6 shown in FIG. 1, and applied to the memories 11-U, 11-L and 11-P, respectively. From the gate 21 only the address read signals ($ADD_0$ to $ADD_4$)R of the upper keyboard are applied to the synchronous detector 12B by the signal $T_U$ from the memory switching circuit 19. In the synchronous detector 12B, synchronous detection is achieved by the address read signals ($ADD_0$ to $ADD_4$)R of the upper keyboard and the content of upper keyboard memory 11-U is read out and written in the main memory circuit (I) 10 sequentially in the channels in which synchronization is detected. When the periods of all the channels have been detected, a period detection end signal $CES_2$ is produced, and applied to the musical waveshape calculator 13. In the musical waveshape calculator 13, the musical waveshape of the upper keyboard written in the main memory circuit (I) 10 is stored and the upper keyboard memory 11-U is specified by the signal $T_U$ from the memory switching circuit 19 and the abovesaid musical waveshape of the upper keyboard is written in the upper keyboard memory 11-U. At this time, the synchronous detector 12A starts synchronous detection and the read out output from the main memory circuit (I) 10 is written in the upper keyboard memory 11-U sequentially in the order of the channels whose synchronization is detected. Upon completion of the synchronous detection of all channels, the period detection end signal $CES_1$ is provided, and applied to the memory switching circuit 19, thus starting the lower keyboard waveshape reload cycle $T_L$.

Further, in the musical waveshape calculator 13, after the detection cycles of the draw bar and tablet switches of the lower keyboard, a complex musical waveshape of the lower keyboard is written in the main memory circuit 10 in the transmission cycle. By the lower keyboard waveshape reload cycle signal $T_L$ from the memory switching circuit 19, the address read signals ($ADD_0$ to $ADD_4$)R of the lower keyboard are supplied to the main memory circuit (I) 10 and the synchronous detector 12B through the gate 21 and the abovesaid operations are repeated, writing the musical waveshape in the lower keyboard memory 11-L. Thereafter, the pedal keyboard waveshape reload cycle $T_P$, the upper keyboard waveshape reload cycle $T_U$, . . . are repeated by the same operations to effect conversion into new musical waveshapes corresponding to the respective keyboards.

Figure 18:
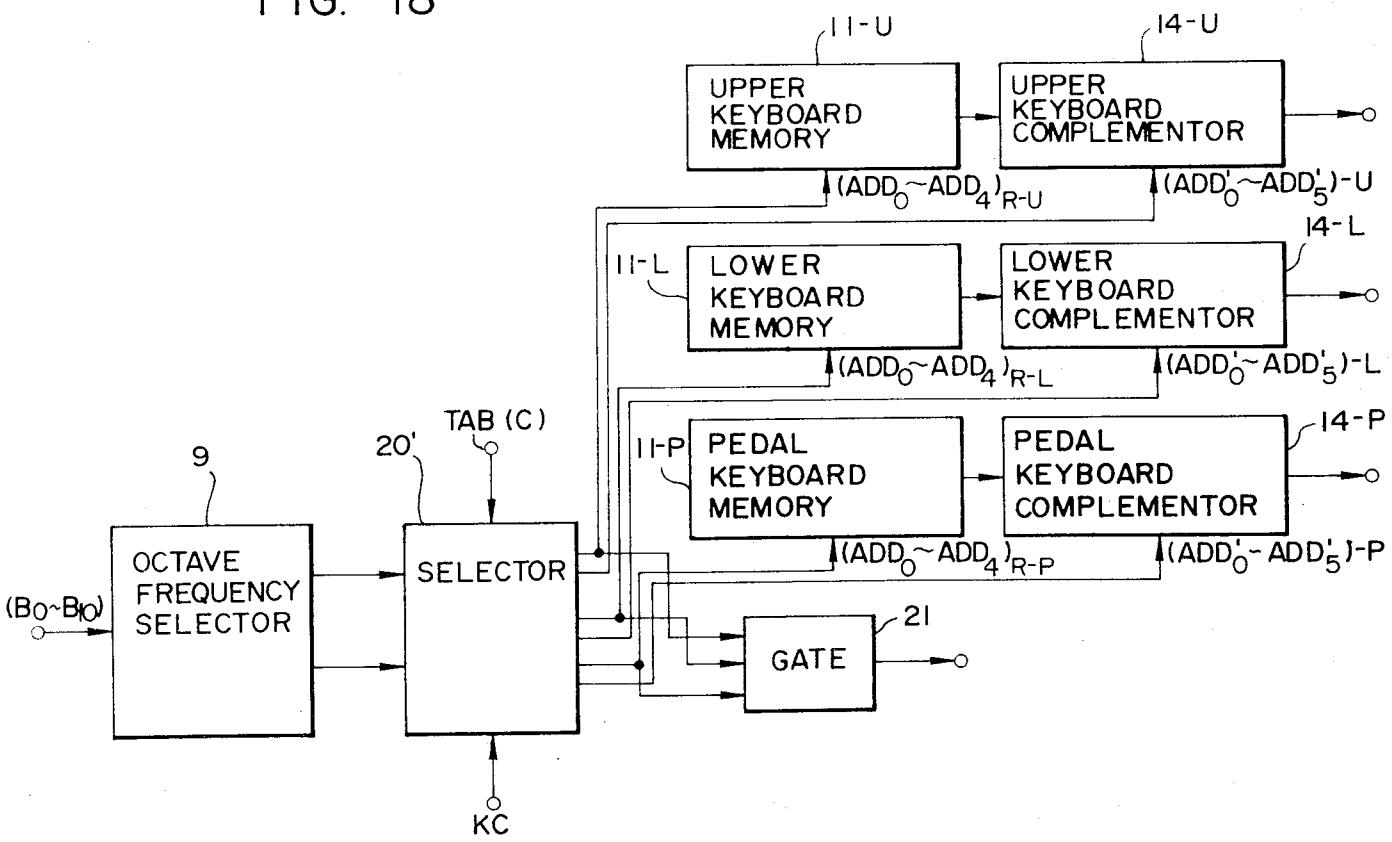
FIG. 18 is a block diagram explanatory of the coupling function in FIG. 17.

FIG. 18 is explanatory of the coupler function mentioned above. In FIG. 18, the main memory circuit (II) 11 and the complementor 14 are provided for each of the upper keyboard (U), the lower keyboard (L) and the pedal keyboard (P). In a selector 20' the address read signals ($ADD_0$ to $ADD_4$)R and the complement control signals ($ADD'_0$ to $ADD'_5$) from the octave frequency selector 9 are divided by the key code KC from the key code detector 6 into the address read signals ($ADD_0$ to $ADD_5$)R and the complement control signals ($ADD'_0$ to $ADD'_5$) of the upper, lower and pedal keyboards, respectively. Then, a transfer of the address read signals and the complement control signals are transferred from the keyboards designated by control signals $T_{AB}(c)$ from coupler control tablets.

Figure 19:
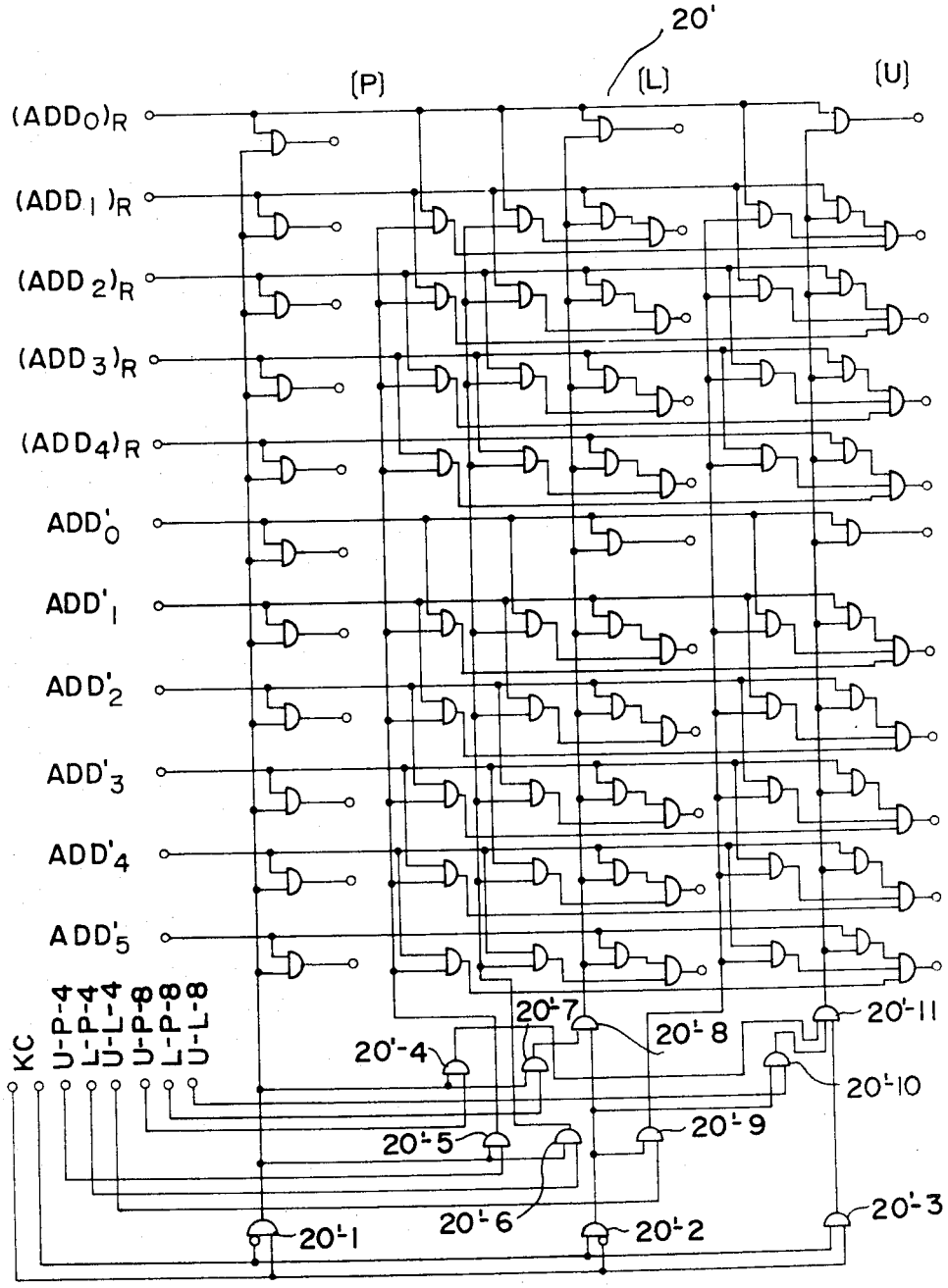
FIG. 19 is a circuit diagram explanatory of a selector shown in FIG. 18.

FIG. 19 illustrates in detail the selector 20'. In FIG. 19, there are shown six specific operative examples of the coupler control tablet, i.e. upper keyboard-lower keyboard 8', 4' (U-L-8,4), upper keyboard-pedal keyboard 8', 4' (U-P-8,4) and lower keyboard-pedal keyboard 8', 4' (L-P-8, 4).

The key codes KC are predetermined, and selected by gate circuits 20'-1, 20'-2 and 20'-3 and the address read signals ($ADD_0$ to $ADD_4$)R and the complement control signal ($ADD'_0$ to $ADD'_5$) from the octave frequency selector 9 are classified. When "1" is applied to the upper keyboard-lower keyboard tablet 8' (U-L-8), an AND gate 20'-10 is turned on and, at the same time, the address read signal and the complement control signal corresponding to the lower keyboard are outputted as the address read signal and the complement control signal for the upper keyboard. In this way, in the case of closure of a key switch of the lower keyboard, a sound of the key of the upper keyboard corresponding to the frequency of the closed key switch of the lower keyboard is produced simultaneously with sound generation from the lower keyboard. In case of the lower keyboard-pedal keyboard tablet 8' (L-P-8), an AND gate 20'-7 is turned on and a sound is produced from the lower keyboard at the same time as a note from the pedal keyboard. In the case of the upper keyboard-pedal keyboard tablet 8' (U-P-8), an AND gate 20'-4 is turned on and a sound is generated from the upper keyboard at the same time as a sound from the pedal keyboard. When "1" is fed to the upper keyboard-lower keyboard tablet 4' (U-L-4), an AND gate 20'-9 is turned on to turn on AND gates respectively connected at one input to the output line of the AND gate 20'-9. The other inputs of these AND gates are each supplied with the address read signal and the complement control signal shifted by one bit relative to each other. This means that upon closure of a key switch of the lower keyboard the address read signal and the complement control signal of the upper keyboard higher than those of the lower keyboard by one octave are selected. In the case of the upper keyboard-pedal keyboard tablet 4' (U-P-4), and AND gate 20'-5 is turned on, by which the address read signal and the complement control signal higher than the depressed key by one octave are selected and a sound of the keyboard thus assigned is generated at the same time as a sound of the depressed key.

As set forth above, in the abovesaid embodiment of this invention, a selector is provided and time-divided memory read signals are classified by key codes and coupler control signals and stored in a plurality of memories, each having stored therein a complex musical waveshape corresponding to each keyboard. Accordingly, various keyboard-keyboard coupler controls can be achieved without increasing or modifying the key code detector accomodating a maximum number of sounds simultaneously generated. And with the simplified construction, it is possible to obtain an inexpensive and highly reliable electronic musical instrument which is also suitable for fabrication with integrated circuits.

As described above, in the musical waveshape calculator 13 shown in FIG. 1, the amplitude values $D_1$ of a musical waveshape at each simple point, the difference value $D_2$ between successive sample points and the sign bit $D_3$ indicative of the positive or negative of the difference value are produced, and written by the address write signals ($ADD_0$ to $ADD_4$)W in one of the main memory circuits (I) 10 and (II) 11. The content of the other main memory circuit is read out by the address read signals ($ADD_0$ to $ADD_4$)R which are produced by selecting the signals $B_0$ to $B_{10}$ from the note clock generator 3 with the octave signal OC from the octave frequency selector 9 corresponding to a depressed key. The read-out content is applied to the complementor 14, which is further supplied with the following complement control signals $ADD'_0$ to $ADD'_5$ directly from the octave frequency selector 9.

Figure 20:
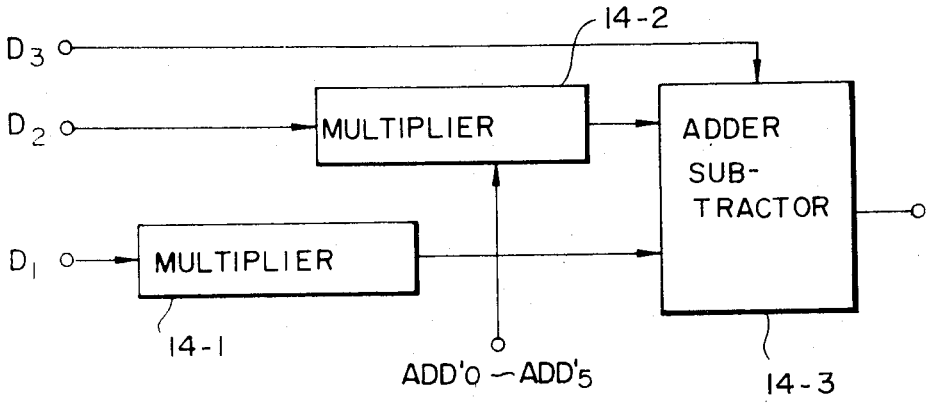
FIG. 20 is a detailed block diagram explanatory of a complementor 14 depicted in FIG. 1.
Figure 21A:
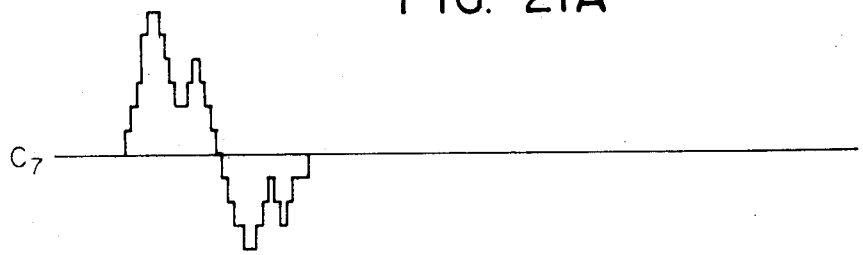
FIGS. 21A, 21B and 21C are diagrams explanatory of the step noise frequency removal function of the complementor of FIG. 20, illustrating waveshapes of the notes $C_7$, $C_6$ and $C_5$ as waveshape data from the main memory circuits (I) 10 and (II) 11.
Figure 21B:
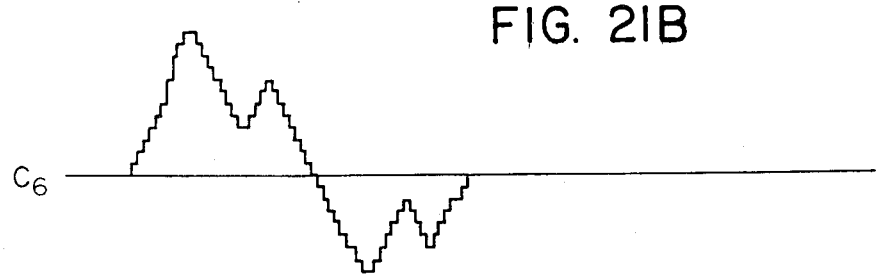
Figure 21C:
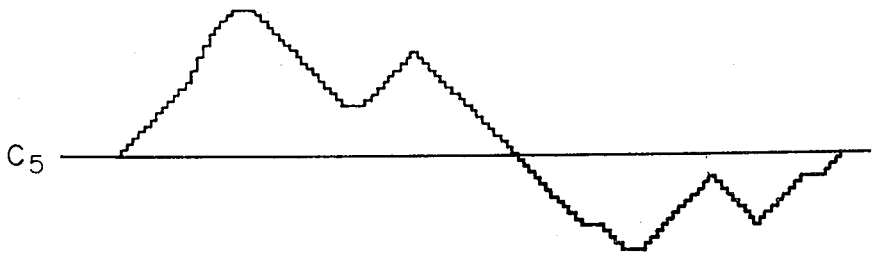

FIG. 20 is a detailed explanatory diagram of the complementor 14. In the block 14, as shown in FIG. 20, in the musical waveshape calculation each sample value ($D_1$) of the musical waveshape, the difference value ($D_2$) between successive sample values and the sign bit ($D_3$) representing the positive or negative of the difference value are multiplied, and the multiplied output is provided to the memory (10,11). The sample value ($D_1$) is applied to the multiplier 14-1 and multiplied by a constant corresponding to the number of bits of each of the address buses ($ADD'_0$ to $ADD'_5$). The difference value ($D_2$) is multiplied by the address buses ($ADD'_0$ to $ADD'_5$). The output from each multiplier is subjected to addition or subtraction in accordance with the sign bit ($D_3$). This provides the same results as those obtainable by sampling using the same sampling block, as shown in FIGS. 21A, 21B and 21C; consequently the sampling noise can be reduced. The block 16 is an accumulator for combining time-divided wave shape which follows key depression, and the composite musical waveshape is applied via the D-A converter 17 to the sound system 18.

In FIGS. 21A, B and C, there are shown the waveshapes of notes $C_7$, $C_6$ and $C_5$ as the waveshape data from the main memory circuits (I) 10 and (II) 11. The waveshape of the note $C_7$ is formed based on the data concerning the amplitude values $D_1$ of the input, the difference values $D_2$ and the sign bits (SB) $D_3$ in Table 9. The data in Table 9 are shown in terms of the difference value, the period number t and the sign bit (SB).

TABLE 9

| Address | Difference Value | t | SB |
|---|---|---|---|
| 0 | 0 | 1 | 1 |
| 1 | 4 | 3 | 1 |
| 2 | 8 | 1 | 1 |
| 3 | 4 | 1 | 1 |
| 4 | 0 | 1 | 1 |
| 5 | 4 | 4 | 0 |
| 6 | 0 | 1 | 0 |
| 7 | 4 | 2 | 1 |
| 8 | 4 | 6 | 0 |
| 9 | 3 | 1 | 0 |
| 10 | 0 | 1 | 1 |
| 11 | 4 | 3 | 1 |
| 12 | 4 | 2 | 1 |
| 13 | 4 | 2 | 0 |
| 14 | 0 | 2 | 1 |
| 15 | 4 | 1 | 1 |

The address read signals ($ADD_0$ to $ADD_4$)R and the complement control signals $ADD'_0$ to $ADD'_5$ in the notes $C_7$, $C_6$ and $C_5$ are selected to be such as shown in the following Tables 10 and 11.

TABLE 10

| | $C_7$ | $C_6$ | $C_5$ |
|---|---|---|---|
| $(ADD_4)R$ | $B_{10}$ | $B_9$ | $B_8$ |
| $(ADD_3)R$ | $B_9$ | $B_8$ | $B_7$ |
| $(ADD_2)R$ | $B_8$ | $B_7$ | $B_6$ |
| $(ADD_1)R$ | $B_7$ | $B_6$ | $B_5$ |
| $(ADD_0)R$ | $B_6$ | $B_5$ | $B_4$ |

TABLE 11

| | $C_7$ | $C_6$ | $C_5$ |
|---|---|---|---|
| $ADD'_4$ | * | $B_{10}$ | $B_{10}$ |
| $ADD'_3$ | * | * | $B_9$ |
| $ADD'_2$ | * | * | * |
| $ADD'_1$ | * | * | * |
| $ADD'_0$ | * | * | * |

(* No complement signal)
The input signals $B_7$, $B_8$, $B_9$, and $B_{10}$ bear such a relation as shown in the following Table 12 in which they are sequentially doubled.

TABLE 12

| | |
|---|---|
| $B_7$ | 0 0 0 0 0 0 0 0 0 1 1 1 1 |
| $B_8$ | 0 0 0 0 1 1 1 1 0 0 0 0 |
| $B_9$ | 0 0 1 1 0 0 1 1 0 0 1 1 |
| $B_{10}$ | 0 1 0 1 0 1 0 1 0 1 0 1 |

In FIG. 20, the amplitude value $D_1$ of the musical waveshape read out of the main memory circuit (I) 10 or (II) 11 is multiplied by a constant 64 in a first multiplier 14-1. The difference value $D_2$ is multiplied by the complement control signals $ADD'_0$ to $ADD'_5$ in a second multiplier 14-2. The outputs from the first and second multipliers 14-1 and 14-2 are both applied to an adder-subtractor 14-3, in which the addition or subtraction of the both inputs is performed dependent upon the sign bit (SB). In the case of the note $C_7$, since the complement control signals $ADD'_0$ to $ADD'_5$ are not provided, as shown in Table 11, the amplitude value $D_1$ is multiplied by the constant 64 in the first multiplier to obtain such a waveshape as shown in FIG. 21A. In the case of the note $C_6$, since the complement control signal $ADD'_4=B_{10}$ is provided, when the signal $B_{10}$ is "1", the difference value $D_2$ is multiplied by 32 in the second multiplier 14-2 and an addition or subtraction is achieved by the adder-subtractor 14-3, providing such a waveshape as shown in FIG. 21B. In the case of the note $C_5$, since the complement control signals $ADD'_4=B_{10}$ and $ADD'_3=B_9$ are provided, when the signals $B_{10}$ and $B_9$ are "1 0", "0 1" and "1 1", the difference value $D_2$ is multiplied by 16, 32 and 48 in the second multiplier 14-2, respectively, thus producing such a waveshape as shown in FIG. 21C. As is understood from the above, sampling is carried out at the same frequency in all notes and a step noise frequency caused by the sampling is uniform throughout the entire sound and lies outside of the audible frequency range. Accordingly, the step noise frequency can be easily removed.

As described above, the musical waveshape data can be stored with a required sampling number for indicating a required harmonic number, so that the system construction is simple and the memory capacity is reduced. Further, by increasing the sampling number with a decrease in the fundamental frequency, a sampling noise is made uniform throughout the entire sound range and outside of the audible frequency range, the noise can be removed.

It will be apparent that many modifications and variations may be effected without departing from the scope of the novel concepts of this invention.

What is claimed is:

1. An electronic musical instrument for digital processing having a tone control in which required musical waveshape data are computed to obtain a complex waveshape, a keyboard having key switches on which a musical note having a frequency and a period is selected by closure of a key switch, and in which the complex waveshape is read out by a read-out frequency of the selected note to produce the selected musical note, the electronic musical instrument comprising:

a calculator coupled to the tone control for calculating the musical waveshape in association with the operation of the tone control in a period of time independent of the period of the selected musical tone;

a read out signal generator for generating a memory read-out signal based on the closure of the key switch;

a period detector for detecting the read-out signal period resulting from the closure of the key switch;

first and second memories storing the musical waveshape from the calculator and read out by the read-out signal; and means for controlling the first and second memories to be written into and read out alternately with each other so that while the first memory is read out by the read-out signal, the musical waveshape from the calculator is written into the second memory, the read out operation is then switched to the second memory by a signal from the period detector in synchronism with the period of the musical note, and after completion of the read out of the first memory, the waveshape from the calculator is written into the first memory while the second memory is read out by the read-out signal, and further comprising:

a memory having stored therein quantized amplitude values of an envelope waveshape, the different values between successive amplitude values of the envelope waveshape, and sign bits representing the positive or negative of the difference values, and for providing high-order and low-order count values of the envelope waveshape, an envelope waveshape generator provided with a high-order and a low-order envelope counter for executing at all times and read-out of said memory; a coincidence circuit for detecting the coincidence between the count value of the high-order envelope counter and an address signal of the memory; a gate circuit opened by a coincidence signal from the coincidence circuit; a first multiplier having two inputs, the amplitude values stored in the memory being applied to one input of the first multiplier and a multiplier value dependent on the number of bits of the low-order envelope counter being applied to the other input of the first multiplier; a second multiplier having two inputs, the difference values stored in the memory being applied to one input of the second multiplier and the count value of the low-order envelope counter being applied as a multiplier value to the other input of the second multiplier; an adder-subtractor clock, the outputs from the first and second multipliers being applied to the adder-subtractor clock; a plurality of channels corresponding to the maximum number of sounds to be simultaneously produced, each channel having a key-code detector; a main oscillator providing a signal to said adder-subtractor clock, said adder subtractor clock producing pulses to the key code detectors of the respective channels based on the signal from the main oscillator; time division clocks for time dividing note signals identifying the note of the closed key switch; a note clock generator circuit having a decoder for distributing the time divided note signals from the time division clocks; note clock generator pulsed by said decoder for variably frequency-dividing the signal from the main oscillator based on the stored data of the first and second memories to thereby generate frequencies within desired sound ranges in a sample period of the musical waveshape written in the first and second memories and read out therefrom, and gate circuit means for gating output signals from the note clock generators for addition or subtraction depending upon the sign bits being positive or negative.

2. An electronic musical instrument as in claim 1, and further comprising a note clock generating device provided with key code detectors for detecting depression and release of a key switch and for generating the note signal identifying the note of the closed key switch and an octave signal identifying the octave thereof for each of the channels; a sequential pulse generator for applying time division to the channels by means of the time division clock, and an octave frequency selector for selecting octave frequencies of the output signals from the gate circuits of the note clock generator circuit by the time divided octave signals of the respective channels for the key code detectors.

3. An electronic musical instrument as in claim 1, wherein said tone control produces a set value and a feet rate, and further comprising divider means for dividing the musical waveshape data into a desired number of periods, each of which is represented by a period number having a desired function and a coefficient value;

a memory for storing each period number and the coefficient value;

a multiplier for multiplying the coefficient value from the memory by the set value from the tone control;

an accumulator for accumulating the multiplied coefficient value from the multiplier based on the period number from the memory;

means for developing a shift pulse corresponding to the feet rate from the tone control; and means for sequentially writing the output signal from the accumulator in a shift register through an adder by means of said shift pulse.

* * * * *